US011311077B2

(12) United States Patent
Pavone et al.

(10) Patent No.: US 11,311,077 B2
(45) Date of Patent: Apr. 26, 2022

(54) FULLY CONVERTIBLE HIGH HEEL-TO-FLAT SHOE

(71) Applicant: Pashion Footwear, Inc., San Luis Obispo, CA (US)

(72) Inventors: Haley Pavone, San Luis Obispo, CA (US); Seiji Alexander van Bronkhorst, Albany, CA (US); Tyler Elise Unbehand, Irvine, CA (US); Daniel William Peter, Portland, OR (US); Mark Christopher Thompson, Portland, OR (US); David Sheldon Perry, Portland, OR (US); Carina Mary Hamel, Portland, OR (US); Robert Hart Ringer, Portland, OR (US)

(73) Assignee: Pashion Footwear, Inc., San Luis Obispo, CA (US)

( * ) Notice: Subject to any disclaimer, the term of this patent is extended or adjusted under 35 U.S.C. 154(b) by 141 days.

(21) Appl. No.: 16/035,321

(22) Filed: Jul. 13, 2018

(65) Prior Publication Data

US 2019/0014860 A1 Jan. 17, 2019

Related U.S. Application Data

(60) Provisional application No. 62/532,890, filed on Jul. 14, 2017.

(51) Int. Cl.
*A43B 13/36* (2006.01)
*A43B 3/24* (2006.01)
(Continued)

(52) U.S. Cl.
CPC ..... *A43B 13/36* (2013.01); *A43B 3/108* (2013.01); *A43B 3/246* (2013.01); *A43B 13/37* (2013.01); *A43B 21/39* (2013.01); *A43B 21/42* (2013.01)

(58) Field of Classification Search
CPC ..... A43B 13/36; A43B 13/37; A43B 3/108; A43B 3/246; A43B 7/38; A43B 21/39; A43B 21/42; A43B 3/24
(Continued)

(56) References Cited

U.S. PATENT DOCUMENTS 1,673,452 A 6/1928 Hegedus
1,773,242 A 8/1930 Siekacz
(Continued)

FOREIGN PATENT DOCUMENTS

CN 104703496 6/2015
CN 106572719 4/2017
(Continued)

OTHER PUBLICATIONS

Extended European Search Report for EP Application No. 18183772.5 mailed from the European Patent Office dated Oct. 8, 2018.
(Continued)

*Primary Examiner* — Khoa D Huynh
*Assistant Examiner* — Uyen T Nguyen
(74) *Attorney, Agent, or Firm* — Fitch, Even, Tabin & Flannery LLP

(57) ABSTRACT

The present disclosure describes a shoe that may be transformed from a high heel shoe to a low heel shoe. The shoe may include three parts: a removable stelo, a removable high heel attachment, and the corresponding attachment systems integrated into the base shoe sole. The removable high heel attachment may be a standard heel of any design, width and height that has a locking system comprising a threaded post
(Continued)

Figure 1:
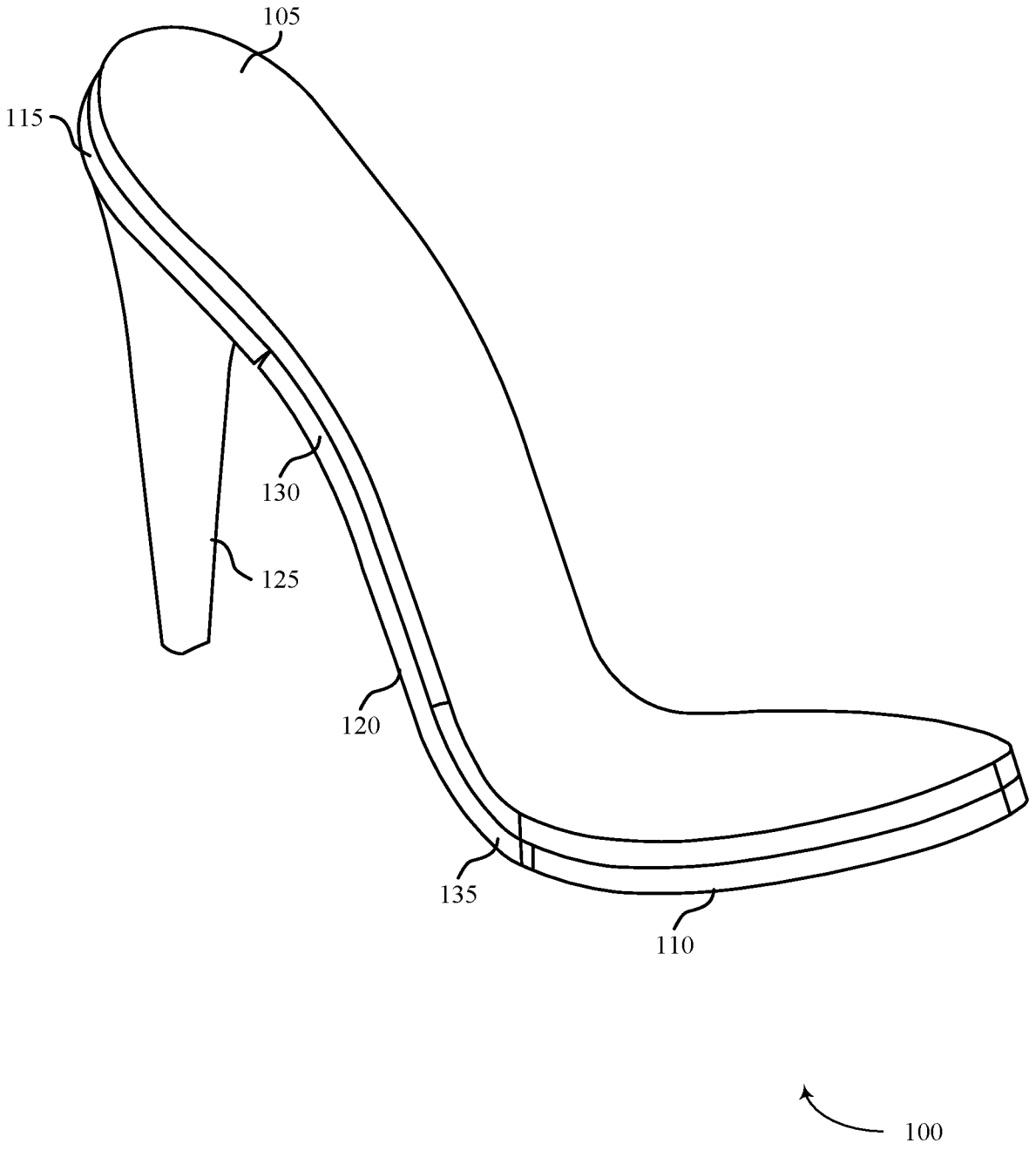

located at the heel base. When the stelo and heel attachment are attached, the shoe may be a high heel shoe. When they are removed, the shoe may be a low heel shoe, or flat shoe.

33 Claims, 26 Drawing Sheets

(51) Int. Cl.
*A43B 21/39* (2006.01)
*A43B 13/37* (2006.01)
*A43B 3/10* (2006.01)
*A43B 21/42* (2006.01)

(58) Field of Classification Search
USPC ..... 36/100
See application file for complete search history.

(56) References Cited

U.S. PATENT DOCUMENTS 2,258,265 A * 10/1941 Schwartz ..... A43B 21/433 36/100
2,267,926 A 12/1941 Kidder
4,400,893 A * 8/1983 Musci ..... A43B 21/42 36/24.5
5,309,651 A * 5/1994 Handel ..... A43B 21/433 36/100
5,347,730 A * 9/1994 Rodriguez Colon .... A43B 3/24 36/100
5,524,365 A * 6/1996 Goldenberg ..... A43B 3/24 36/36 C
5,675,916 A 10/1997 Lewis
5,692,322 A * 12/1997 Lombardino ..... A43B 3/24 36/100
5,953,836 A * 9/1999 Watt ..... A43B 21/37 36/42
7,377,056 B2 * 5/2008 Snow ..... A43B 13/12 36/24.5
9,693,598 B1 * 7/2017 Rose ..... A43B 3/246
10,064,450 B1 9/2018 Groves-Hill
2003/0097770 A1 * 5/2003 Karasawa ..... A43B 13/41 36/97
2006/0075662 A1 * 4/2006 Schupbach ..... A43B 21/36 36/100
2006/0196082 A1 * 9/2006 Robbins ..... A43B 3/24 36/42
2007/0256330 A1 * 11/2007 Wallin ..... A43B 21/39 36/102
2008/0271343 A1 * 11/2008 Ordenes Haag ..... A43B 3/246 36/101
2010/0139123 A1 * 6/2010 Alan ..... A43B 13/141 36/100
2012/0047770 A1 * 3/2012 Dean ..... A43B 21/30 36/103
2012/0055048 A1 * 3/2012 Haupt ..... A43B 21/437 36/34 R
2012/0085000 A1 4/2012 Alaimo
2012/0137543 A1 * 6/2012 Kemp ..... A43B 21/39 36/100
2012/0260530 A1 10/2012 Policastro
2013/0062231 A1 * 3/2013 Angiulo ..... A43B 21/38 206/278
2013/0247413 A1 * 9/2013 Cumbus ..... A43B 3/246 36/42
2013/0312285 A1 11/2013 Sharma
2013/0333246 A1 * 12/2013 Weller ..... A43B 13/36 36/103
2014/0096412 A1 4/2014 Obie
2014/0137436 A1 5/2014 Saccullo
2014/0208620 A1 * 7/2014 Damodar ..... A43B 21/36 36/25 R
2014/0259777 A1 * 9/2014 Morris Thill ..... A43B 13/34 36/100
2015/0020414 A1 1/2015 Mulholland
2015/0113837 A1 * 4/2015 Isinhue ..... A43B 21/42 36/34 R
2015/0201704 A1 * 7/2015 Huber ..... A43B 21/40 36/25 R
2015/0264994 A1 9/2015 Guardado
2016/0073725 A1 * 3/2016 Guenoun ..... A43B 13/36 36/100
2016/0106180 A1 4/2016 Green
2017/0095029 A1 * 4/2017 Berberian ..... A43B 13/28
2017/0119090 A1 * 5/2017 Chang ..... A43B 7/1445
2017/0156441 A1 * 6/2017 Ho ..... A43B 13/42
2017/0231316 A1 * 8/2017 Sethi ..... A43B 23/22 36/97
2017/0340051 A1 * 11/2017 Rogers ..... A43B 21/30
2018/0140048 A1 * 5/2018 Shi ..... H02J 7/00
2018/0146740 A1 * 5/2018 Berberian ..... A43B 7/1435
2019/0045878 A1 * 2/2019 Olsson ..... A43B 3/246

FOREIGN PATENT DOCUMENTS

EP 1864585 A1 * 12/2007 ..... A43B 7/144
FR 2836024 8/2003

OTHER PUBLICATIONS

First Office Action for Chinese patent Application No. 201810778400.3 mailed from the National Intellectual Property Administration, P.R. China dated Mar. 3, 2021.
Second Office Action for Chinese Patent Application No. 201810778400.3 mailed from the National Intellectual Property Administration, P.R. China dated Aug. 9, 2021.

* cited by examiner

FULLY CONVERTIBLE HIGH HEEL-TO-FLAT SHOE

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

New transformable heel-to-flat footwear and the necessary elements for creation of such a product are discussed herein. In the following description, for purposes of explanation, numerous specific details are set forth in order to provide a thorough understanding of the present invention. It will be evident, however, to one skilled in the art that the present invention may be practiced without these specific details.

The present disclosure utilizes the term "stelo" to refer to removable rigid sole support, or shank, including a shank, shankpiece, or shank spring that serves as the bridge between the heel and the ball of the shoe. A stelo may be built into the midsole to offer reinforcement to create the arch of the heel. The contour and design of the shank depends on the type of shoe and height of the heel. Its purpose is to maintain the shape or style of the shoe by preventing it from collapsing or distorting and providing elasticity to the design.

A stelo may serve the same purpose as a traditional shank. However, a stelo can be removed from the shoe, allowing the user to modify the shape, design, and function of the shoe especially relating to the adjustment of the heel height. The present disclosure describes the use of a stelo for a high heel shoe, but it may also be used for work boots, flats, men's dress shoes, bike shoes, bowling shoes, orthotic shoes, welted shoes, or any other shoe not listed with a heel piece.

The term "heel base" as used herein refers to the upper surface of a removable heel attachment present at the end of the high heel attachment opposite the "top piece," with the "top piece" being the industry term for the bottom of the physical high heel that comes into contact with the ground when walking. Thus, the heel base is the end of the removable heel attachment that is directly beneath the "counter" of a standard high heel when fully assembled.

FIG. 1 shows an example of an isometric view of a high heel shoe base 100 in accordance with aspects of the present disclosure. High heel shoe base 100 may be an example of, or include aspects of, the corresponding element described with reference to FIGS. 2-9, and 13-15. High heel shoe base 100 may include shoe sole element 105, toebox base 110, attachment platform 115, stelo 120, heel attachment 125, concave portion 130, and convex portion 135.

As shown, the flexible shoe sole element 105, the solid toebox base 110, the removable heel attachment platform 115, the removable stelo 120, and the removable heel attachment 125 are used to create the structure of a high heel shoe. In operation, the flexible shoe sole element 105 is coupled to the solid toebox base 110 and the removable heel attachment platform 115 to create the base shoe sole. The removable stelo 120 is inserted to provide the structural support needed in the raised high heel formation, and the removable heel attachment 125 is attached to create the completed high heel formation.

An convertible high heel is shown comprising of three novel parts: a removable stelo 120, a removable heel attachment 125, and the corresponding attachment systems integrated into the base. The removable stelo 120 is a rigid insert of any material that has a curvature resembling the shape of a standard high-heel shoe sole in the elevated heel position (generally "S"-shaped or curved, as viewed from the side so as to provide a concave portion 130 proximate to where the removable stelo 120 interfaces with the solid toebox base 110, and, optionally, a convex portion 135 proximate to where the removable stelo 120 interfaces with the removable heel attachment platform 115). The removable heel attachment 125 may be a high heel of any height, design, width, and material that contains the threaded post located at the heel base.

In accordance with the present embodiment of the high-heel shoe formation, the removable stelo 120 is attached by connecting the toebox interlock tabs into the toebox interlock slots. The removable sole support lock key will be connected to the corresponding receiving mechanism located on the solid heel portion of the removable sole support lock keyhole. When the heel interlocking mechanism is completely assembled, the interlocking mechanism will create an opening defined by the thread track created by threaded key arc section and the threaded keyhole section.

The removable heel attachment 125 is threadably coupled to the removable heel support attachment by threading the threaded post located on removable heel attachment 125 into the thread track of the opening created jointly by the threaded key arc section and the threaded keyhole section. In its final form, the removable heel attachment 125 attaches at the opening and at least partially covers and secures the removable sole support lock keyhole, preventing accidental removal of the removable heel attachment platform 115.

In operation of the flat shoe formation, the removable heel attachment 125 and the removable stelo 120 can be removed, allowing the flexible base shoe sole to be used autonomously. In practice, a user will generally begin with the shoe configured as a high heel, with the removable heel attachment platform 115 and the removable heel attachment 125 secured in place. When the user wishes to convert the shoe into a flat, the removable heel attachment 125 is rotated to disengage the thread track from the threaded post of the removable heel attachment 125. This disengagement results in the separation of the removable heel attachment 125 from the shoe and releases the removable sole support lock key from the removable sole support lock keyhole. The removable heel attachment platform 115 is then rotated away from the flexible base shoe sole, and the toebox interlock tabs are slid toward the rear of the shoe to disengage the toebox interlock tabs from the toebox interlock slots.

With the removal of the removable stelo 120, the stelo 120 no longer supports the shank of the shoe in a high heel configuration, and the flexible base shoe sole allows the removable heel attachment platform 115 to drop to the ground and serve as the heel of the shoe. The removable stelo 120 and the removable heel attachment 125 can then be stored away, with the shoe assuming the form of a flat. This process is reversed to convert the shoe from a flat into a high heel.

Optional add-ons to this product include, but are not limited to, a high heel wedge attachment of any height, width and material; a removable sole support attachment created in conjunction with a different connecting mechanism than the one previously described; a removable heel attachment 125 created in conjunction with a different connecting mechanism than the one previously described.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The shoe sole element 105 may be an example of a flexible sole element interposed between the toe box platform and the heel platform. Shoe sole element 105 may be an example of, or include aspects of, the corresponding element described with reference to FIGS. 2-5, 10-13, 15, and 22-24.

The toebox base 110 may be an example of a toe box platform including a stelo receiver. In some examples, the stelo receiver includes a forefoot pin oriented laterally at a proximal portion of the toe box platform. Toebox base 110 may be an example of, or include aspects of, the corresponding element described with reference to FIGS. 2-6, 9-13, and 14.

The attachment platform 115 may be an example of a heel platform including an interlocking portion. In some examples, the interlocking portion includes a puck coupled to the heel platform. Attachment platform 115 may be an example of, or include aspects of, the corresponding element described with reference to FIGS. 2-7, 9-13, 15, 17, and 22-24.

The stelo 120 may include a rigid shank, a toe interlock, and a heel interlock, wherein the toe interlock is configured to removably interlock with the stelo receiver, and the heel interlock is configured to removably interlock with the interlocking portion, and wherein the stelo 120 is configured to juxtapose with the flexible sole element providing a rigid support to the flexible sole element.

In some examples, the toe interlock includes a notch configured to interlock with the forefoot pin at the stelo receiver. In some examples, the stelo 120 is interposed between the removeable heel and the interlocking portion. In some examples, the stelo 120 includes a leading edge rib configured to engage the interlocking portion. In some examples, the stelo 120 has a lateral curved profile.

In some examples, the stelo 120 includes a post coaxial with an axis of rotation of the removable heel, wherein the removable heel includes a cylindrical cavity configured to receive the post. In some examples, the stelo 120 includes the post, wherein the post includes a compressible distal end. In some examples, the stelo 120 includes a recurve. Stelo 120 may be an example of, or include aspects of, the corresponding element described with reference to FIGS. 2-9, 12-14, 16, and 22-24.

The heel attachment 125 may be an example of a removable heel removably coupleable to the heel platform at the interlocking portion. In some examples, the stelo 120 and the removable heel are configured to remain together upon removal of the removable heel from the interlocking portion. In some examples, the removable heel is configured to release from the interlocking portion by rotating the removable heel by at least fifteen degrees. Heel attachment 125 may be an example of, or include aspects of, the corresponding element described with reference to FIGS. 2-5, 9, 12, 14, 18, 19, and 22-24.

Figure 2:
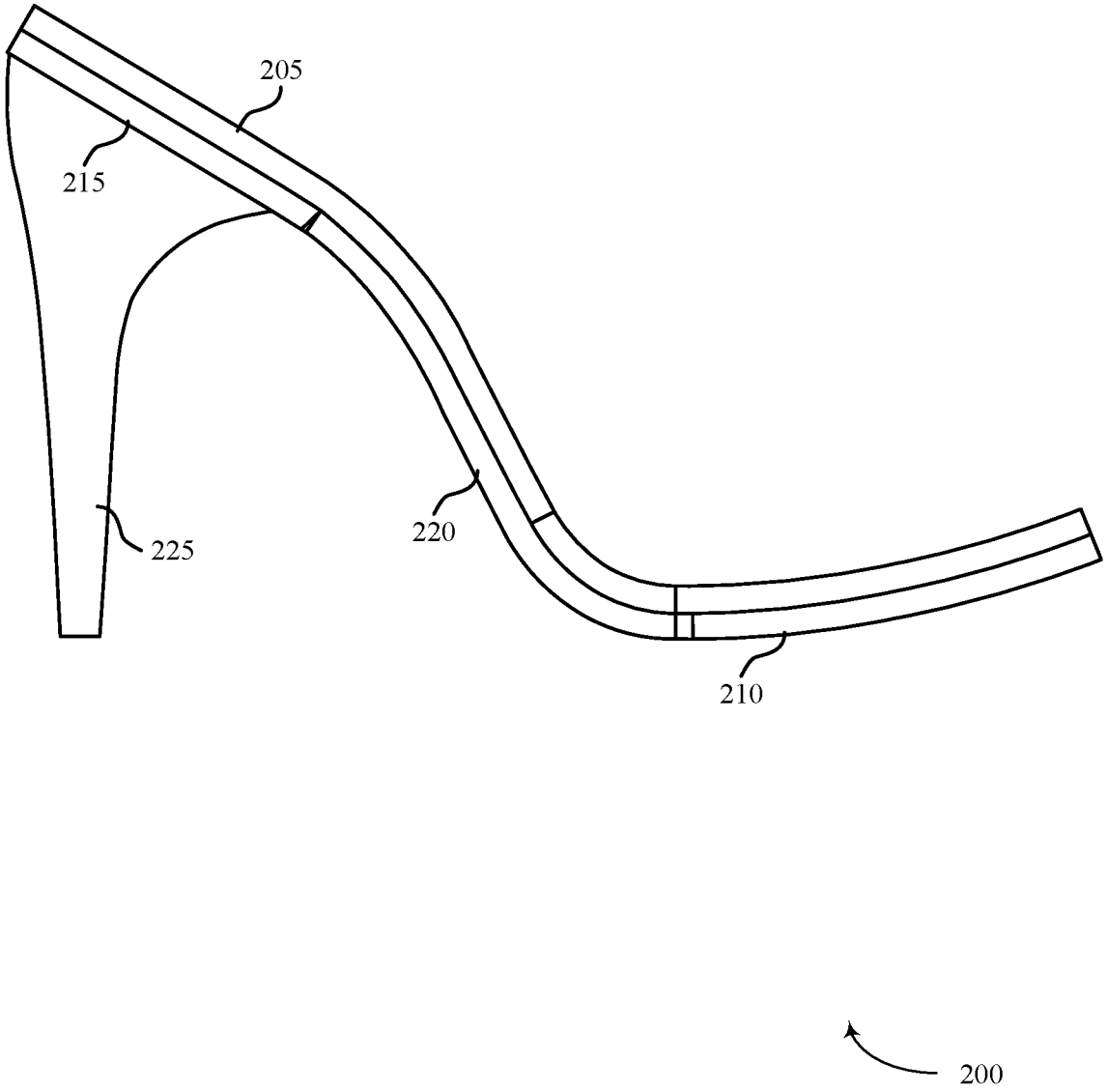

FIG. 2 shows an example of a side view of a high heel shoe base 200 in accordance with aspects of the present disclosure. High heel shoe base 200 may be an example of, or include aspects of, the corresponding element described with reference to FIGS. 1, 3-9, and 13-15. High heel shoe base 200 may include shoe sole element 205, toebox base 210, attachment platform 215, stelo 220, and heel attachment 225.

As shown, the flexible shoe sole element 205, the solid toebox base 210, the removable heel attachment platform 215, the removable stelo 220, and the removable heel attachment 225 are used to create the structure of a high heel shoe. In operation, the flexible shoe sole element 205 is coupled to the solid toebox base 210 and the removable heel attachment platform 215 to create the base shoe sole. The removable stelo 220 is inserted to provide the structural support needed in the raised high heel formation, and the removable heel attachment 225 is attached to create the completed high heel formation.

Shoe sole element 205 may be an example of, or include aspects of, the corresponding element described with reference to FIGS. 1, 3-5, 10-13, 15, and 22-24. Toebox base 210 may be an example of, or include aspects of, the corresponding element described with reference to FIGS. 1, 3-5, 6, 9-13, and 14. Attachment platform 215 may be an example of, or include aspects of, the corresponding element described with reference to FIGS. 1, 3-5-7, 9-13, 15, 17, and 22-24. Stelo 220 may be an example of, or include aspects of, the corresponding element described with reference to FIGS. 1, 3-9, 12-14, 16, and 22-24. Heel attachment 225 may be an example of, or include aspects of, the corresponding element described with reference to FIGS. 1, 3-5, 9, 12, 14, 18, 19, and 22-24.

Figure 3:
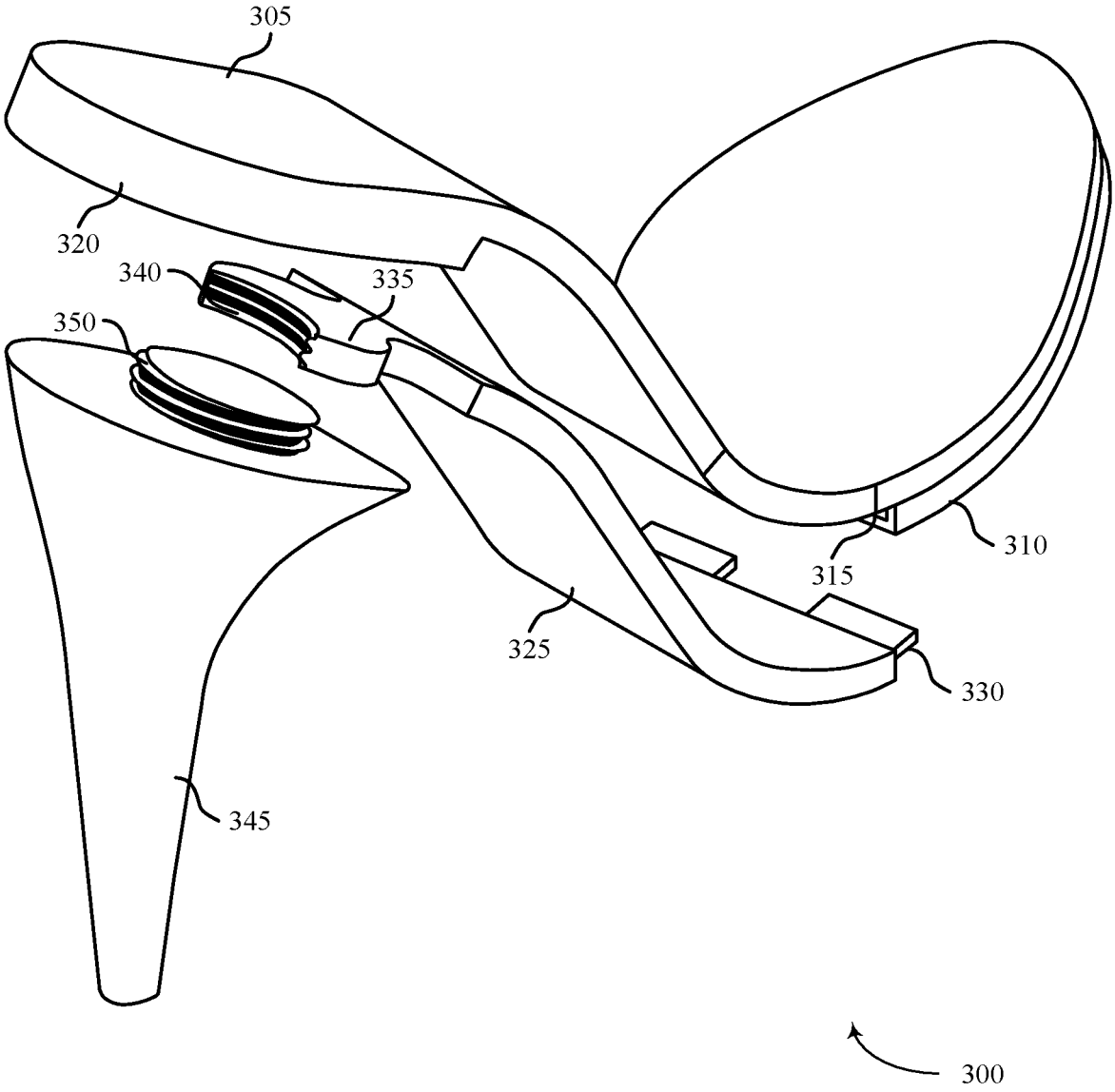

FIG. 3 shows an example of an isometric separated view of a high heel shoe base 300 in accordance with aspects of the present disclosure. The features are shown separated to show how they structurally fit together in one embodiment of the complete high heel assembly. In operation, the features are combined as described to execute the complete high heel formation. High heel shoe base 300 may be an example of, or include aspects of, the corresponding element described with reference to FIGS. 1, 2, 4-9, and 13-15.

High heel shoe base 300 may include shoe sole element 305, toebox base 310, toebox interlock slots 315, attachment platform 320, stelo 325, toebox interlock tabs 330, sole support lock key 335, keyhole section 340, heel attachment 345, and post 350.

In the present embodiment, the removable stelo 325 contains a dual interlocking mechanism, with the removable sole support lock key 335 located at the heel end of the removable stelo 325 (where the removable stelo 325 interfaces with the removable heel attachment platform 320) that then connects into the corresponding mechanism at the heel of the removable sole support lock keyhole, and the toebox interlock tabs 330 located at the toebox end of the removable stelo 325 (where the removable stelo 325 interfaces with the solid toebox base 310) that then connects to the toebox interlock slots 315.

In other embodiments, the removable stelo 325 includes just one interlocking mechanism located on either end of the removable stelo 325, or any number of interlocking mechanisms located elsewhere on the removable stelo 325.

The toebox interlock tabs 330 of the aforementioned dual interlocking mechanism located on the removable stelo 325 is the mechanism located at the end interacting with the base shoe sole. In the present embodiment, this interlocking mechanism includes a locking mechanism located at the edge of the removable stelo 325 that then connects to the toebox interlock slots 315 located on the toebox portion of the solid toebox base 310. In other embodiments, one of ordinary skill in the art will appreciate that various interlocking mechanisms are suitable to achieve the objectives described herein. By way of example, the interlocking mechanism may be a tongue-and-groove interlocking mechanism in which the toebox interlock slots 315 includes a groove and the toebox interlock tabs 330 includes a tongue or tab that slides into the groove in order to constrain movement of the toebox interlock tabs 330 relative to the toebox interlock slots 315 to a single direction vector.

The removable sole support lock key 335 of the aforementioned dual interlocking mechanism located on the removable stelo 325 is the mechanism located at the end interacting with the removable heel attachment platform 320.

Shoe sole element 305 may be an example of, or include aspects of, the corresponding element described with reference to FIGS. 1, 2, 4, 5, 10-13, 15, and 22-24. Toebox base 310 may be an example of, or include aspects of, the corresponding element described with reference to FIGS. 1, 2, 4-6, 9-13, and 14.

Toebox interlock slots 315 may be an example of, or include aspects of, the corresponding element described with reference to FIGS. 4, 5, and 8. Attachment platform 320 may be an example of, or include aspects of, the corresponding element described with reference to FIGS. 1, 2, 4, 5-7, 9-13, 15, 17, and 22-24.

Stelo 325 may be an example of, or include aspects of, the corresponding element described with reference to FIGS. 1, 2, 4-9, 12-14, 16, and 22-24. Toebox interlock tabs 330 may be an example of, or include aspects of, the corresponding element described with reference to FIGS. 5-7, and 8. Sole support lock key 335 may be an example of, or include aspects of, the corresponding element described with reference to FIGS. 6-8, and 9. Keyhole section 340 may be an example of, or include aspects of, the corresponding element described with reference to FIGS. 5-8, and 9.

Heel attachment 345 may be an example of, or include aspects of, the corresponding element described with reference to FIGS. 1, 2, 4, 5, 9, 12, 14, 18, 19, and 22-24. Post 350 may be an example of, or include aspects of, the corresponding element described with reference to FIG. 9.

Figure 4:
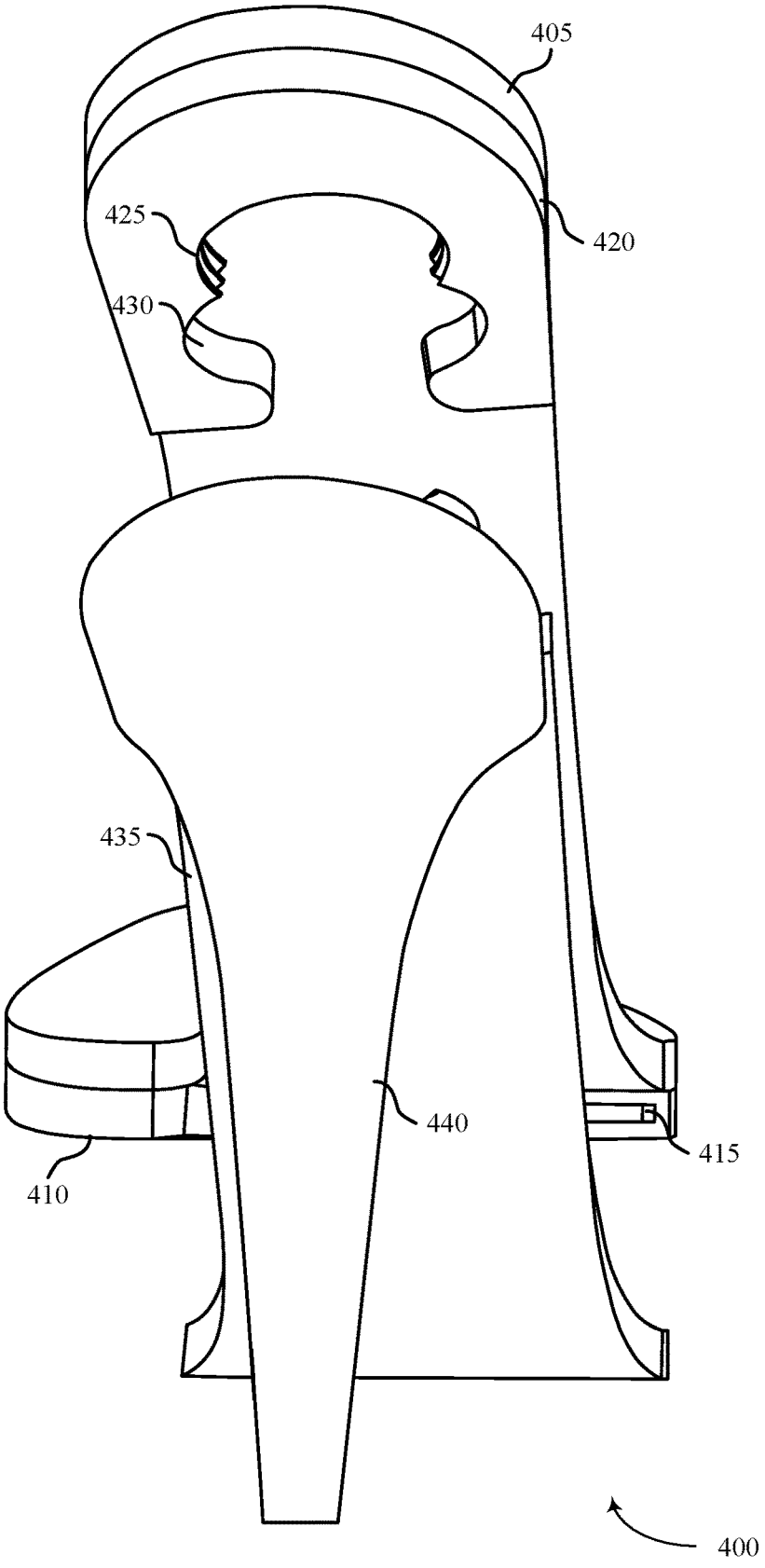

FIG. 4 shows an example of a back view of a high heel shoe base 400 in accordance with aspects of the present disclosure. The features are shown separated to show how they structurally fit together in one embodiment of the complete high heel assembly. In operation, the features are combined as described to execute the complete high heel formation.

High heel shoe base 400 may be an example of, or include aspects of, the corresponding element described with reference to FIGS. 1-3, 5-9, and 13-15. High heel shoe base 400 may include shoe sole element 405, toebox base 410, toebox interlock slots 415, attachment platform 420, sole support lock keyhole 425, key arc section 430, stelo 435, and heel attachment 440.

Shoe sole element 405 may be an example of, or include aspects of, the corresponding element described with reference to FIGS. 1-3, 5, 10-13, 15, and 22-24. Toebox base 410 may be an example of, or include aspects of, the corresponding element described with reference to FIGS. 1-3, 5, 6, 9-13, and 14.

Toebox interlock slots 415 may be an example of, or include aspects of, the corresponding element described with reference to FIGS. 3, 5, and 8. Attachment platform 420 may be an example of, or include aspects of, the corresponding element described with reference to FIGS. 1-3, 5-7, 9-13, 15, 17, and 22-24.

Sole support lock keyhole 425 may be an example of, or include aspects of, the corresponding element described with reference to FIGS. 5-7, 9, and 10. Key arc section 430 may be an example of, or include aspects of, the corresponding element described with reference to FIGS. 5-7, 9, and 10.

Stelo 435 may be an example of, or include aspects of, the corresponding element described with reference to FIGS. 1-3, 5-9, 12-14, 16, and 22-24. The heel attachment 440 may be an example of a removable heel removably coupleable to the heel platform at the interlocking portion. Heel attachment 440 may be an example of, or include aspects of, the corresponding element described with reference to FIGS. 1-3, 5, 9, 12, 14, 18, 19, and 22-24.

Figure 5:
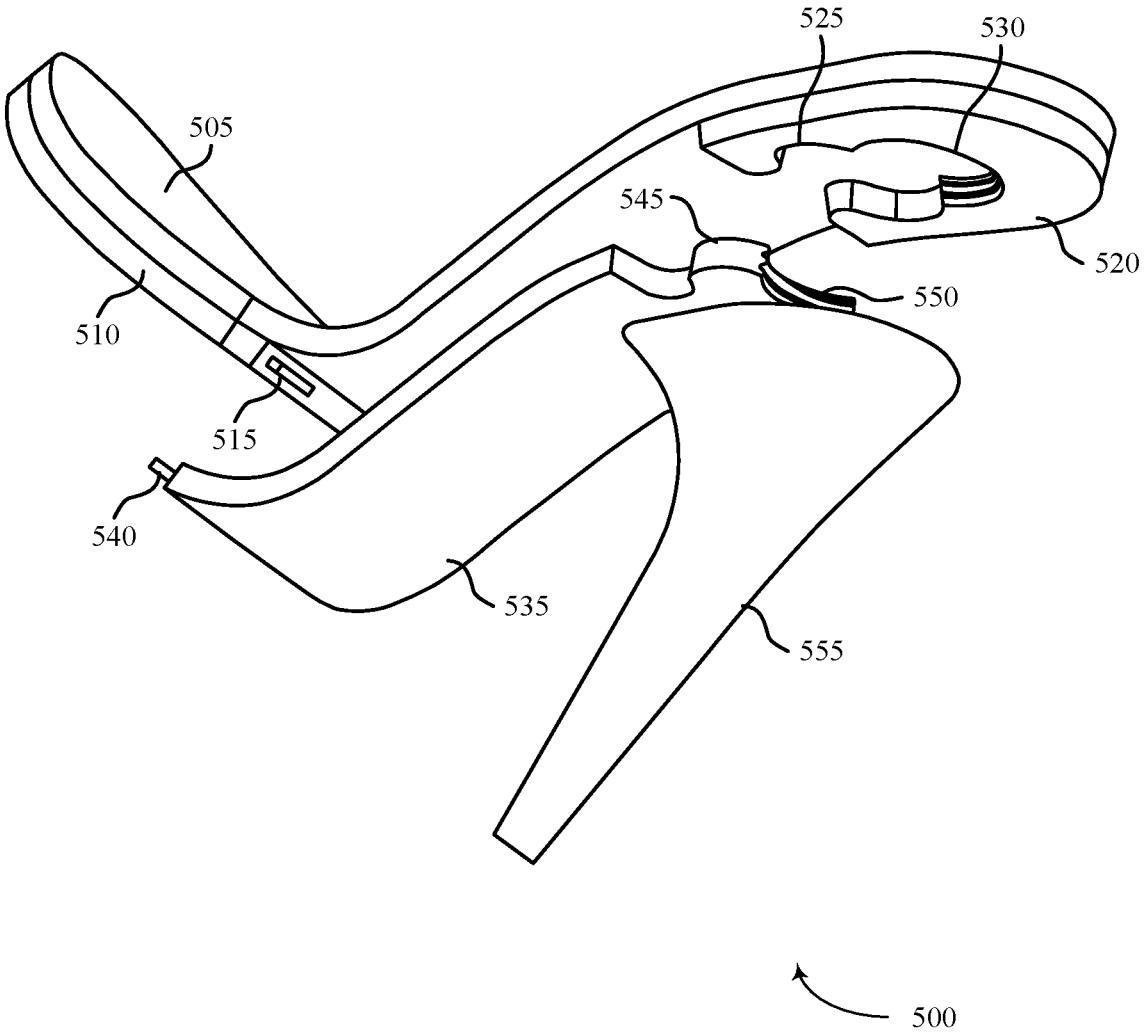

FIG. 5 shows an example of an isometric view of a high heel shoe base 500 in accordance with aspects of the present disclosure. The features are shown separated to show how they structurally fit together in one embodiment of the complete high heel assembly. In operation, the features are combined as described to execute the complete high heel formation.

High heel shoe base 500 may be an example of, or include aspects of, the corresponding element described with reference to FIGS. 1-4, 6-9, and 13-15. High heel shoe base 500 may include shoe sole element 505, toebox base 510, toebox interlock slots 515, attachment platform 520, sole support lock keyhole 525, key arc section 530, stelo 535, toebox interlock tabs 540, keyhole section 545, and heel attachment 550.

Shoe sole element 505 may be an example of, or include aspects of, the corresponding element described with reference to FIGS. 1-4, 10-13, 15, and 22-24. Toebox base 510 may be an example of, or include aspects of, the corresponding element described with reference to FIGS. 1-4, 6, 9-13, and 14. Toebox interlock slots 515 may be an example of, or include aspects of, the corresponding element described with reference to FIGS. 3, 4, and 8.

The attachment platform 520 may be an example of a heel platform including an interlocking portion. Attachment platform 520 may be an example of, or include aspects of, the corresponding element described with reference to FIGS. 1-4, 6, 7, 9-13, 15, 17, and 22-24.

Sole support lock keyhole 525 may be an example of, or include aspects of, the corresponding element described with reference to FIGS. 4, 6, 7, 9, and 10. Key arc section 530 may be an example of, or include aspects of, the corresponding element described with reference to FIGS. 4, 6, 7, 9, and 10.

Stelo 535 may be an example of, or include aspects of, the corresponding element described with reference to FIGS. 1-4, 6-9, 12-14, 16, and 22-24. Toebox interlock tabs 540 may be an example of, or include aspects of, the corresponding element described with reference to FIGS. 3, and 6-8.

Sole support lock keyhole 525 may be an example of, or include aspects of, the corresponding element described with reference to FIGS. 4, 6, 7, 9, and 10. Keyhole section 545 may be an example of, or include aspects of, the corresponding element described with reference to FIGS. 3, 6-8, and 9. Heel attachment 550 may be an example of, or include aspects of, the corresponding element described with reference to FIGS. 1-4, 9, 12, 14, 18, 19, and 22-24.

Figure 6:
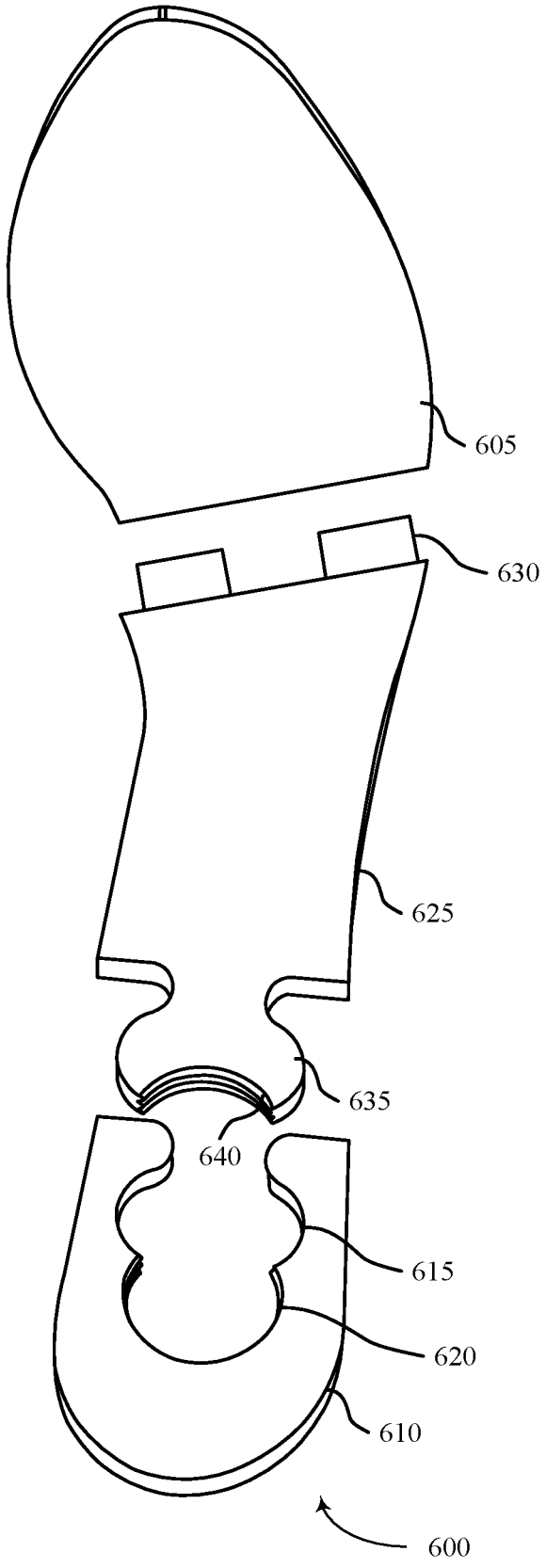

FIG. 6 shows an example of a top view of a high heel shoe base 600 in accordance with aspects of the present disclosure. The features are shown separated to show how they structurally fit together in the present embodiment of the complete high heel outsole assembly. In operation, the features are combined as described to execute the complete high heel outsole formation.

High heel shoe base 600 may be an example of, or include aspects of, the corresponding element described with reference to FIGS. 1-5, 7-9, and 13-15. High heel shoe base 600 may include toebox base 605, attachment platform 610, sole support lock keyhole 615, key arc section 620, stelo 625, toebox interlock tabs 630, sole support lock key 635, and keyhole section 640.

Toebox base 605 may be an example of, or include aspects of, the corresponding element described with reference to FIGS. 1-5, 9-13, and 14. Attachment platform 610 may be an example of, or include aspects of, the corresponding element described with reference to FIGS. 1-5, 7, 9-13, 15, 17, and 22-24.

Sole support lock keyhole 615 may be an example of, or include aspects of, the corresponding element described with reference to FIGS. 4, 5, 7, 9, and 10. Key arc section 620 may be an example of, or include aspects of, the corresponding element described with reference to FIGS. 4, 5, 7, 9, and 10.

Stelo 625 may be an example of, or include aspects of, the corresponding element described with reference to FIGS. 1-5, 7-9, 12-14, 16, and 22-24. Toebox interlock tabs 630 may be an example of, or include aspects of, the corresponding element described with reference to FIGS. 3, 5, 7, and 8. Sole support lock key 635 may be an example of, or include aspects of, the corresponding element described with reference to FIGS. 3, 7, 8, and 9. Keyhole section 640 may be an example of, or include aspects of, the corresponding element described with reference to FIGS. 3, 5, 7, 8, and 9.

Figure 7:
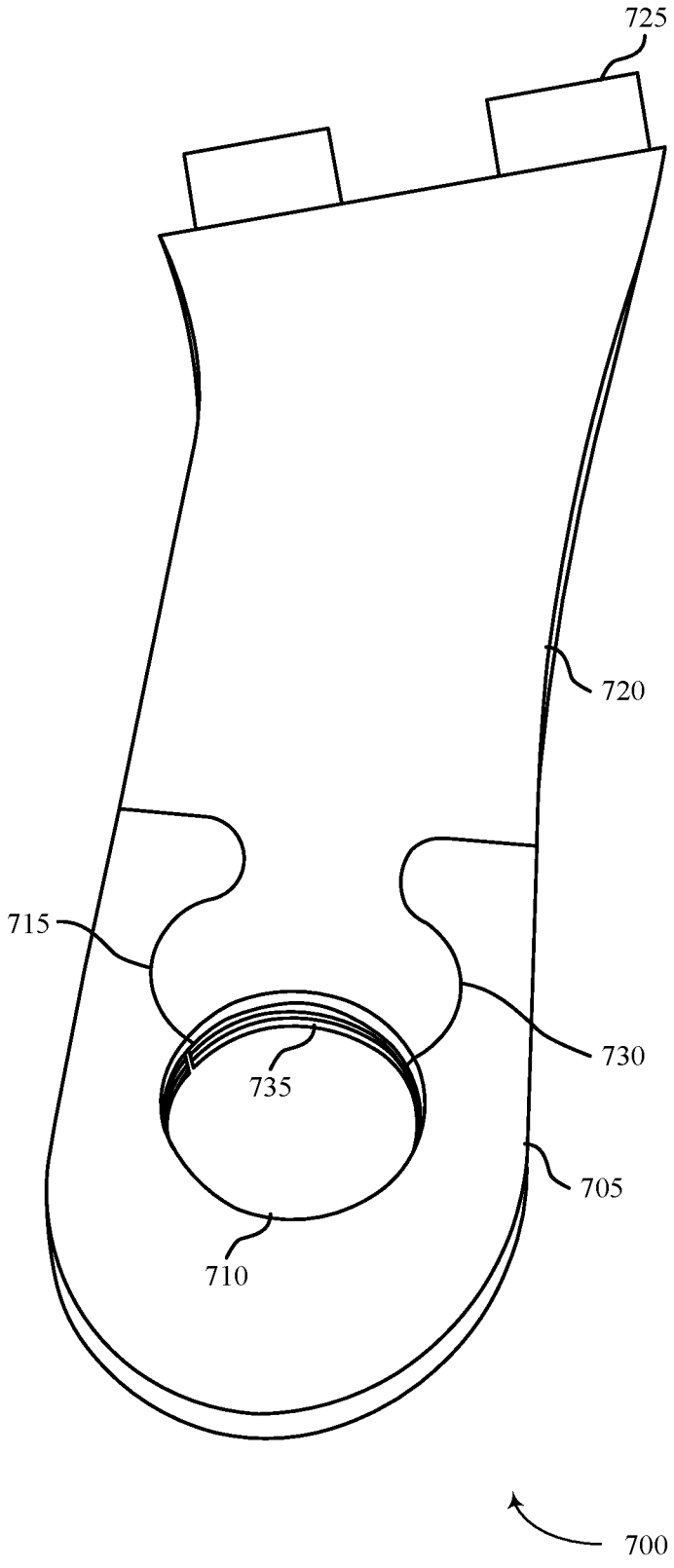

FIG. 7 shows an example of a top view of a high heel shoe base 700 in accordance with aspects of the present disclosure. The features are shown assembled to show how they structurally fit together to create, in one embodiment, the complete threaded heel connecting mechanism. In operation, the features are combined as described to execute the complete threaded heel connecting mechanism by jointly using the threaded keyhole section 735 and the threaded key arc section 715 to create the finished thread track needed to insert the threaded post of the removable heel attachment.

High heel shoe base 700 may be an example of, or include aspects of, the corresponding element described with reference to FIGS. 1-6, 8, 9, and 13-15. High heel shoe base 700 may include attachment platform 705, sole support lock keyhole 710, key arc section 715, stelo 720, toebox interlock tabs 725, sole support lock key 730, and keyhole section 735.

In a present embodiment, an interlocking mechanism includes a locking mechanism located at the removable sole support lock key 730 of the removable stelo 720 that connects to a "keyhole" cavity in the removable sole support lock keyhole 710, with threads running along the threaded keyhole section 735. The threaded keyhole section 735 interlocks with threads in the threaded post when combined with a remaining portion of the thread track located at the threaded key arc section 715 adjacent to the removable sole support lock keyhole 710. The removable sole support lock key 730 is constrained by the removable sole support lock keyhole 710 to move relative to the removable sole support lock key 730 in the direction of a second direction vector, wherein the second direction vector is not parallel to the single direction vector. When the removable sole support lock key 730 and the removable sole support lock keyhole 710 are interlocked, and the thread tracks are aligned, the threaded post is threaded into the resulting threaded opening, and tightened in place.

This arrangement simultaneously secures the removable sole support lock key 730 to the removable sole support lock keyhole 710 and secures the removable heel attachment to the convertible high heel. In other embodiments, different connecting mechanism is at the location of the removable sole support lock key 730, the removable sole support lock keyhole 710 is replaced with a protrusion or a cavity, and the thread track created by threaded keyhole section 735 and the threaded key arc section 715 to interact with the threaded post is replaced by a singular autonomously operating thread track, multiple thread tracks in a different execution, or a different insertion mechanism altogether.

As shown, the removable heel attachment platform 705 also includes a portion of the removable sole support lock keyhole 710 for the removable sole support attachment with the corresponding heel locking mechanism located at the removable sole support insert. Other possible embodiments of the mechanism could include other formations of a threading track, and other locking systems besides threading including but not limited to slide tracks, slots, prong, click and push systems. In regards to other embodiments of the mechanism, the extrusion and insertion points of this mechanism can be executed in any foreseeable shape.

Attachment platform 705 may be an example of, or include aspects of, the corresponding element described with reference to FIGS. 1-6, 9-13, 15, 17, and 22-24. Sole support lock keyhole 710 may be an example of, or include aspects of, the corresponding element described with reference to FIGS. 4-6, 9, and 10. Key arc section 715 may be an example of, or include aspects of, the corresponding element described with reference to FIGS. 4-6, 9, and 10.

Stelo 720 may be an example of, or include aspects of, the corresponding element described with reference to FIGS. 1-6, 8, 9, 12-14, 16, and 22-24. Toebox interlock tabs 725 may be an example of, or include aspects of, the corresponding element described with reference to FIGS. 3, 5, 6, and 8.

Sole support lock key 730 may be an example of, or include aspects of, the corresponding element described with reference to FIGS. 3, 6, 8, and 9. Keyhole section 735 may be an example of, or include aspects of, the corresponding element described with reference to FIGS. 3, 5, 6, 8, and 9.

Figure 8:
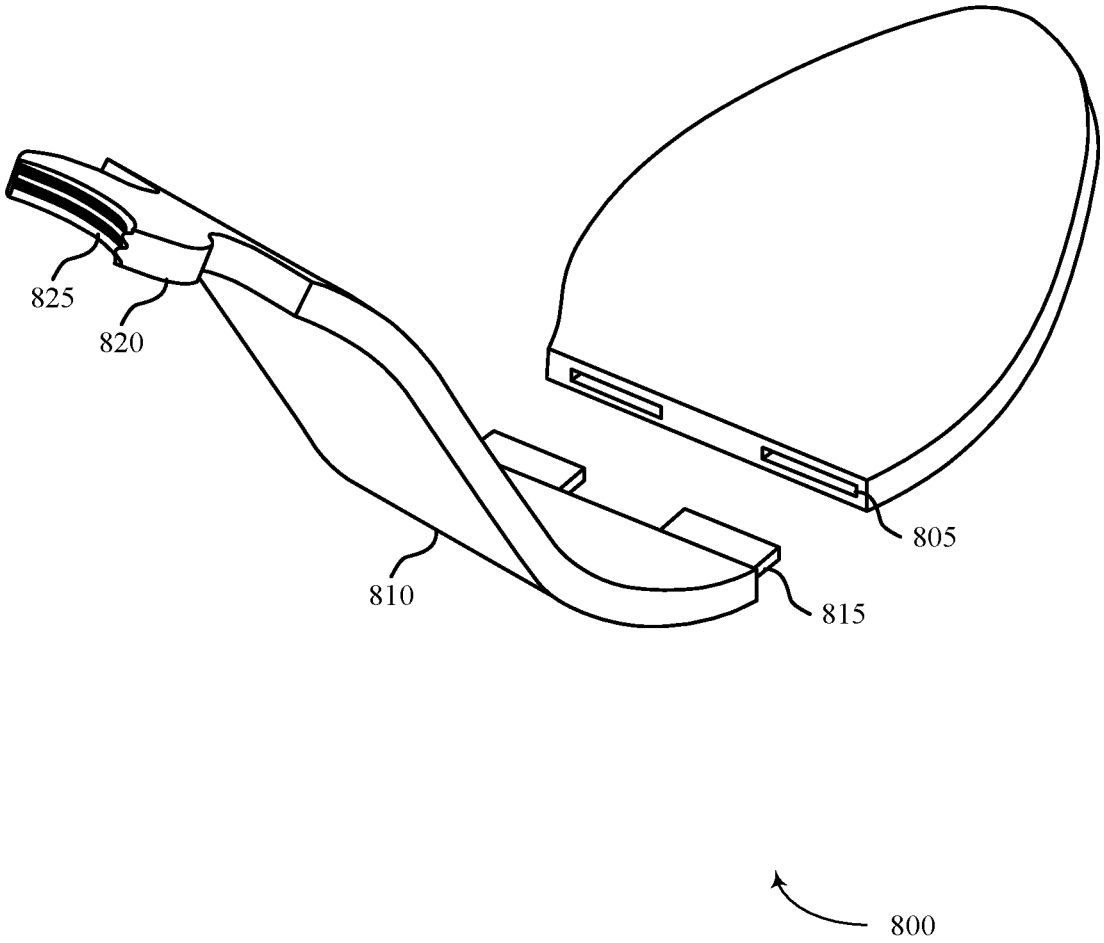

FIG. 8 shows an example of an isometric view of a high heel shoe base 800 in accordance with aspects of the present disclosure. The features are shown disassembled to show how the removable stelo 810 connects to the solid toebox base when executing the present embodiment of the high heel formation. In operation, the toebox interlock tabs 815 are coupled to the toebox interlock slots 805.

High heel shoe base 800 may be an example of, or include aspects of, the corresponding element described with reference to FIGS. 1-7, 9, and 13-15. High heel shoe base 800 may include toebox interlock slots 805, stelo 810, toebox interlock tabs 815, sole support lock key 820, and keyhole section 825.

In the embodiment shown, the solid toebox base contains toebox interlock slots 805 along the back portion and interior corresponding to the toebox interlock tabs 815. In other embodiments of the invention, any type of connecting mechanism could be used at the juncture of the toebox interlock slots 805 and the toebox interlock tabs 815 including but not limited to slide tracks, prongs, and wedge-type insertions with the receptors and/or extrusions located on either portion of the mechanism and in any number.

Toebox interlock slots 805 may be an example of, or include aspects of, the corresponding element described with reference to FIGS. 3, 4, and 5. Stelo 810 may be an example of, or include aspects of, the corresponding element described with reference to FIGS. 1-7, 9, 12-14, 16, and 22-24.

Toebox interlock tabs 815 may be an example of, or include aspects of, the corresponding element described with reference to FIGS. 3, 5, 6, and 7. Sole support lock key 820 may be an example of, or include aspects of, the corresponding element described with reference to FIGS. 3, 6, 7, and 9. Keyhole section 825 may be an example of, or include aspects of, the corresponding element described with reference to FIGS. 3, 5-7, and 9.

Figure 9:
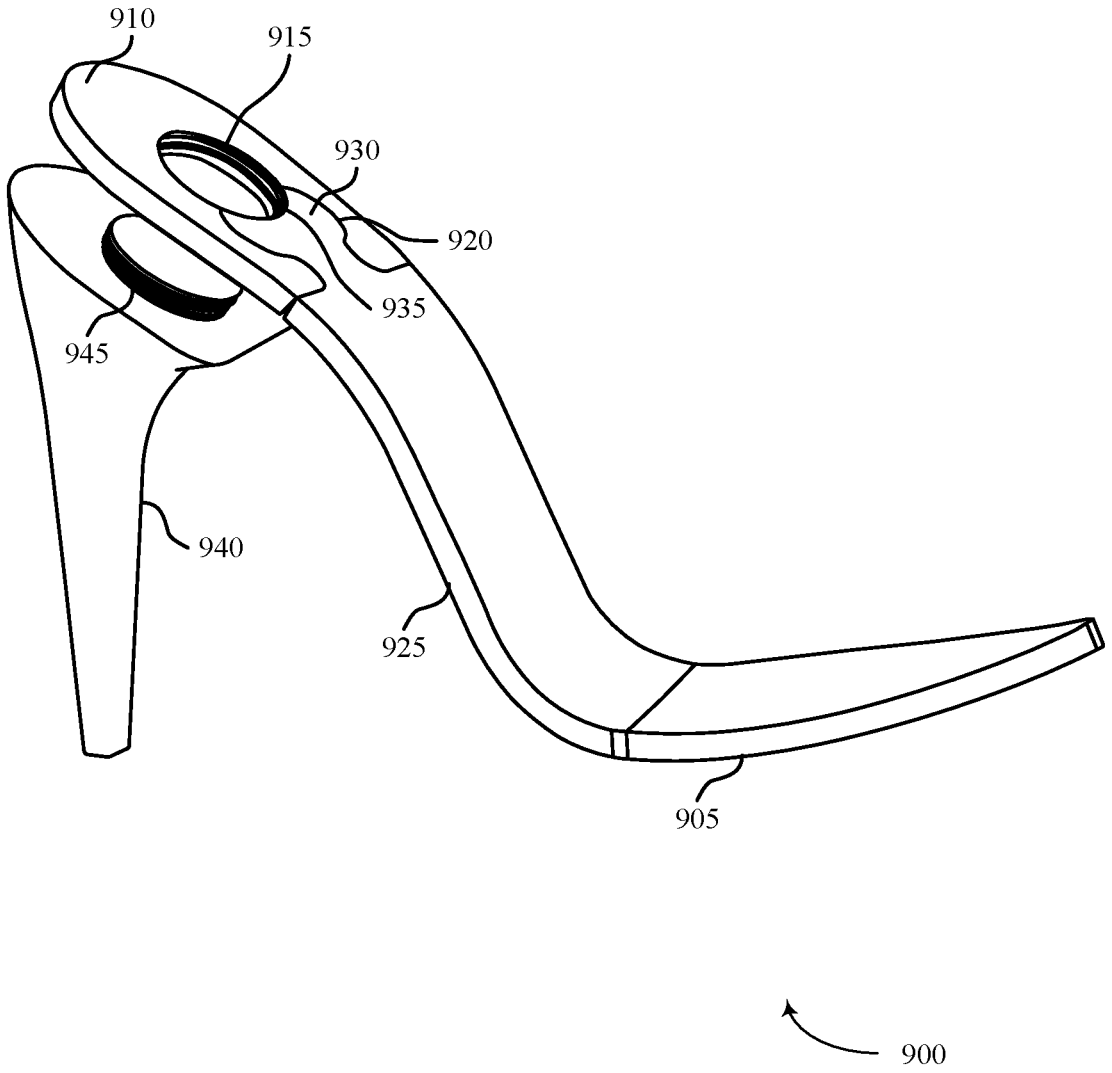

FIG. 9 shows an example of an isometric view of a high heel shoe base 900 in accordance with aspects of the present disclosure. High heel shoe base 900 may be an example of, or include aspects of, the corresponding element described with reference to FIGS. 1-8, and 13-15. High heel shoe base 900 may include toebox base 905, attachment platform 910, sole support lock keyhole 915, key arc section 920, stelo 925, sole support lock key 930, keyhole section 935, heel attachment 940, and post 945.

The threaded keyhole section 935 and threaded key arc section 920 form the finished thread track and are shown assembled to show how the disassembled removable heel attachment 940 and threaded post 945 integrate into the mechanism when fully assembled.

In the embodiment as shown, the interlocking mechanism includes the threaded post 945. The threaded post 945 is threaded into the thread track created by the removable sole support lock keyhole 915 and the threaded key arc section 920. Other embodiments of this locking mechanism may include different shape varieties pertaining to the mechanism located at the threaded post 945, other formations of a thread track other than the thread track created by the combination of the removable sole support lock keyhole 915 and the threaded key arc section 920, and other locking systems besides threading including but not limited to slide tracks, slots, prongs, and click and push systems.

Threading along the internal edge of this threaded key arc section 920 works in conjunction with the threading along the threaded keyhole section 935 to provide the complete thread track to allow for insertion of the removable heel attachment 940 as shown.

Toebox base 905 may be an example of, or include aspects of, the corresponding element described with reference to FIGS. 1-6, 10-13, and 14. Attachment platform 910 may be an example of, or include aspects of, the corresponding element described with reference to FIGS. 1-7, 10-13, 15, 17, and 22-24.

Sole support lock keyhole 915 may be an example of, or include aspects of, the corresponding element described with reference to FIGS. 4, 5-7, and 10. Key arc section 920 may be an example of, or include aspects of, the corresponding element described with reference to FIGS. 4, 5-7, and 10.

Stelo 925 may be an example of, or include aspects of, the corresponding element described with reference to FIGS. 1-8, 12-14, 16, and 22-24. Sole support lock key 930 may be an example of, or include aspects of, the corresponding element described with reference to FIGS. 3, and 6-8.

Keyhole section 935 may be an example of, or include aspects of, the corresponding element described with reference to FIGS. 3, 5-7, and 8. The heel attachment 940 may be an example of a removable heel removably coupleable to the heel platform at the interlocking portion.

Heel attachment 940 may be an example of, or include aspects of, the corresponding element described with reference to FIGS. 1-5, 12, 14, 18, 19, and 22-24. Post 945 may be an example of, or include aspects of, the corresponding element described with reference to FIG. 3.

Figure 10:
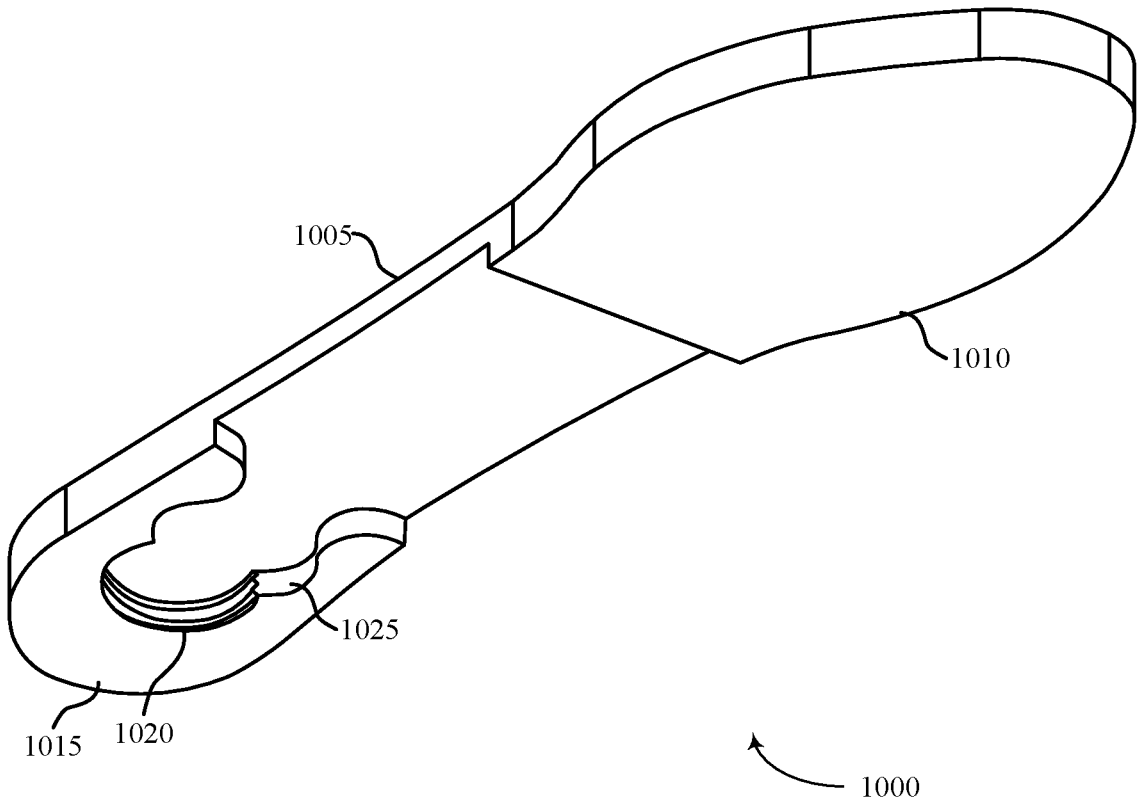

FIG. 10 shows an example of an isometric bottom view of the base shoe sole 1000 in accordance with aspects of the present disclosure. Base shoe sole 1000 may be an example of, or include aspects of, the corresponding element described with reference to FIG. 11. Base shoe sole 1000 may include shoe sole element 1005, toebox base 1010, attachment platform 1015, sole support lock keyhole 1020, and key arc section 1025.

When all assembled as shown in the figure, the flexible shoe sole element 1005, the solid toebox base 1010, the removable heel attachment platform 1015, the removable sole support lock keyhole 1020, and the threaded key arc section 1025 combine to form the flexible base shoe sole 1000. In operation of the present embodiment of the flat shoe execution, this base shoe sole 1000 functions autonomously as a shoe sole itself.

The flexible base shoe sole 1000 as shown includes three elements, the first of which is a flexible shoe sole that runs the length of the flexible shoe sole element 1005. The flexible shoe sole element 1005 approximates the shape and flexibility of a standard flat shoe sole and can be included of any material, but will be flexible in nature. The flexible shoe sole element 1005 is attached to two solid pieces that in combination make up the flexible base shoe sole 1000. The first of these solid pieces is attached to the toebox portion of the solid toebox base 1010. The solid toebox base 1010 approximates the shape and flexibility of a standard shoe sole element 1005 located at the outsole portion of the toebox section of a shoe. The solid toebox base 1010 can be out of any suitable material and is solid in its execution.

The second solid piece that will make up the solid toebox base 1010 in its entirety will be attached to the heel portion of the shoe at the removable heel attachment platform 1015. It will resemble the shape of a standard flat shoe heel, and in one embodiment will contain an indented center section in an arc-shape that follows the shape of the outer edge of the heel.

Shoe sole element 1005 may be an example of, or include aspects of, the corresponding element described with reference to FIGS. 1-5, 11, 12, 13, 15, and 22-24. Toebox base 1010 may be an example of, or include aspects of, the corresponding element described with reference to FIGS. 1-6, 9, 11, 12, 13, and 14. Attachment platform 1015 may be an example of, or include aspects of, the corresponding element described with reference to FIGS. 1-7, 9, 11, 12, 13, 15, 17, and 22-24.

Sole support lock keyhole 1020 may be an example of, or include aspects of, the corresponding element described with reference to FIGS. 4-7, and 9. Key arc section 1025 may be an example of, or include aspects of, the corresponding element described with reference to FIGS. 4-7, and 9.

Figure 11:
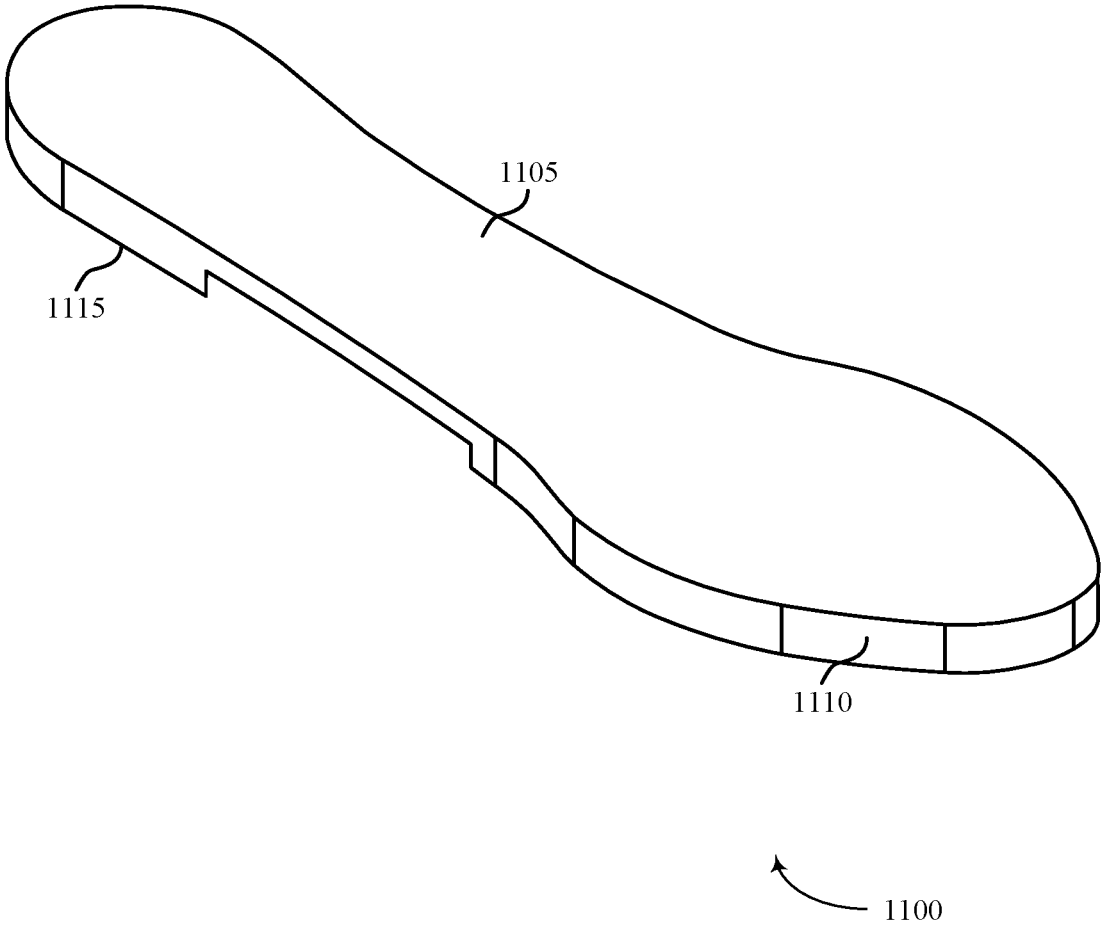

FIG. 11 shows an example of an isometric top view of the base shoe sole 1100 in accordance with aspects of the present disclosure. Base shoe sole 1100 may be an example of, or include aspects of, the corresponding element described with reference to FIG. 10. Base shoe sole 1100 may include shoe sole element 1105, toebox base 1110, and attachment platform 1115.

When all assembled in conjunction as shown in the figure, the flexible shoe sole element 1105, the solid toebox base 1110, and the removable heel attachment platform 1115 combine to create the flexible base shoe sole 1100. In operation of the present embodiment of the flat shoe execution, this flexible base shoe sole 1100 functions itself as a shoe sole when the shoe is configured as a flat.

Shoe sole element 1105 may be an example of, or include aspects of, the corresponding element described with reference to FIGS. 1-5, 10, 12, 13, 15, and 22-24. Toebox base 1110 may be an example of, or include aspects of, the corresponding element described with reference to FIGS. 1-6, 9, 10, 12, 13, and 14. Attachment platform 1115 may be an example of, or include aspects of, the corresponding element described with reference to FIGS. 1-7, 9, 10, 12, 13, 15, 17, and 22-24.

Figure 12:
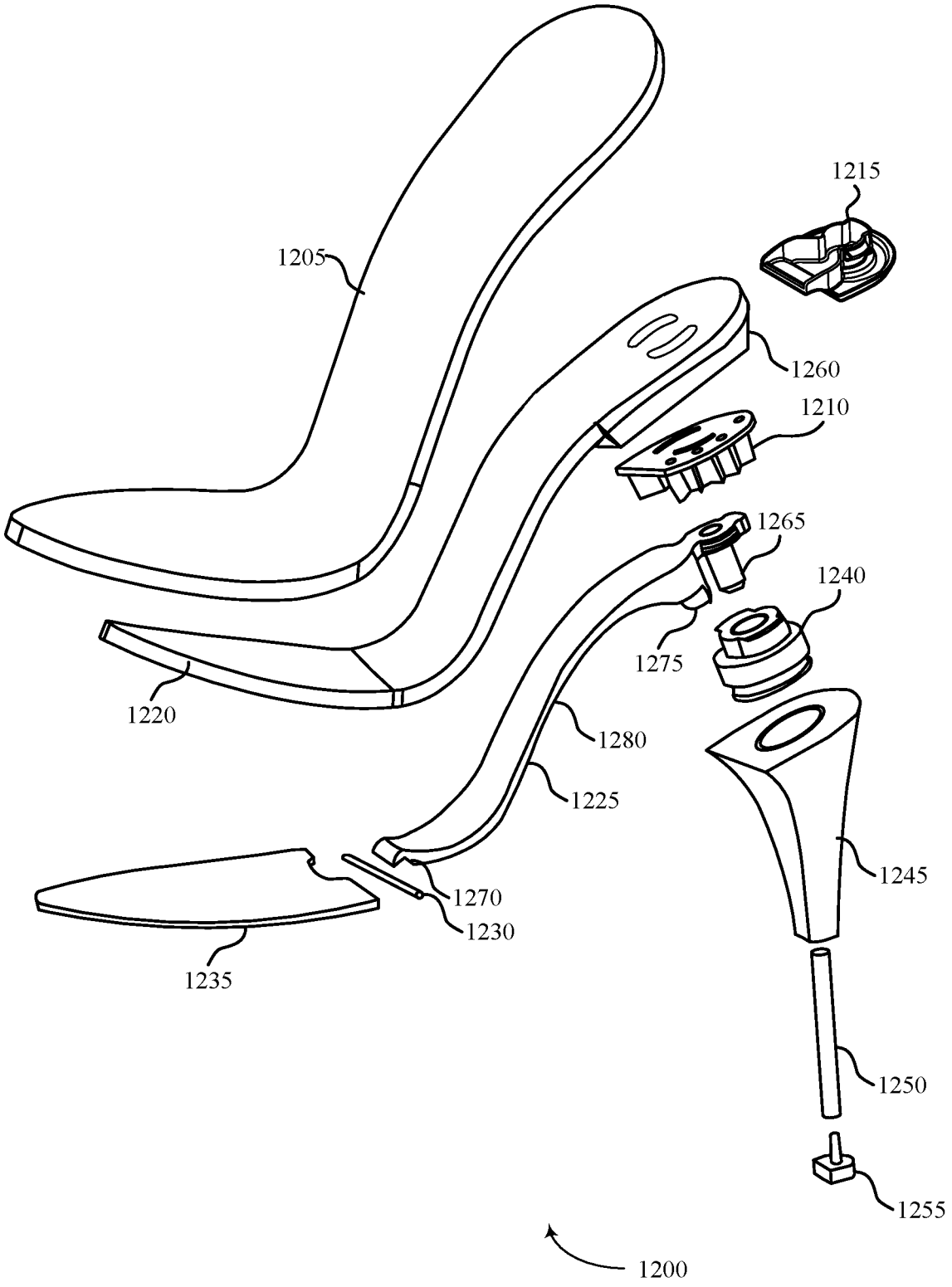

FIG. 12 shows an example of an isometric separated view of a high heel shoe 1200 base in accordance with aspects of the present disclosure. High heel shoe 1200 may include footbed 1205, attachment platform 1210, heel cap 1215, shoe sole element 1220, stelo 1225, forefoot pin 1230, toebox base 1235, heel lock 1240, heel attachment 1245, heel rod 1250, heel tip 1255, heel platform 1260, heel interlock pin 1265, toe interlock 1270, leading edge rib 1270, and shank 1280.

In some examples, the heel attachment 1245 may be used as a fastener to attach the removable stelo 1225. The attachment platform 1210 (a.k.a. receiving component, or "puck") may be co-molded with the shoe sole element 1220 at the heel platform 1260. The stelo 1225 and the heel attachment 1245 may be attached together to install and remove as a single unit. They may also be pulled apart and separated. For example, the heel attachment 1245 and stelo 1225 may be removed using a quarter turn clockwise and a pivot about the forefoot pin 1230. The angle of the stelo 1225 from around the forefoot pin 1230 may range from 15 degrees to 90 degrees. In some examples, a pivot of 35 degrees may be used to clear the forefoot pin 1230.

The stelo 1225 may be a removable shank, shankpiece, or shank spring that inserts into a slot between the shoe sole element 1220 and a forefoot pin 1230 attached to the outsole toebox platform 1235 and is secured in place when in an arched position. A hook on the toe box end of the shank (the toe interlock 1270) curves around the forefoot pin 1230 to secure it in place.

The heel end of the stelo 1225 may have a snap-in plug (the heel interlock pin 1265) onto which the detachable heel lock 1240 locks. The stelo 1225 is the partial width and partial length of the shoe, running from the ball part of the shoe sole element 1220 to the center of the heel platform 1260. The shape of the stelo 1225 may be similar to a shoe shank, in that it follows the arch of the heeled shoe. The purpose of the stelo 1225 is to create an arch in the shoe and maintain the structure of the shoe when the detachable heel attachment 1245 is secured in place.

The stelo 1225 is built into the midsole and runs the length of the shoe from heel to ball, corresponding to the medial and lateral arches. The stelo 1225 may be attached in any of the following areas of the shoe: the toe box, the sole including the platform, ball, or midsole, the bridge or waist, the bottom filling, or the heel including the heel base, breast, and seat.

Attachment mechanism types for the stelo 1225 include but are not limited to a dual interlocking mechanism, twisting mechanism, slide tracks, wedge-type insertions with receptors or extrusions, slots, prong, click and push systems, or threading. The stelo 1225 can be made of wood, steel, carbon fiber, plastic, nylon, fiberglass, Kevlar, or any other material in any combination and ratio.

In some cases, the stelo 1225 may be the primary determinant of overall shoe stiffness. Thus, the stelo 1225 may be designed to be stiff enough and broad enough to add the required stability to the heeled shoe, but leave enough material in the shoe sole element 1220 such that the flat shoe is sufficiently stiff and stable. Stiffness of the stelo 1225 may be maximized by using a curved profile and central rib (running down the length or most of the length of the stelo, normal to the arc of the curved profile), and may be supported with additional ribs (e.g., parallel to the central rib).

Potential shapes for the stelo 1225 include but are not limited to a strip or ribbon of a plated material, that can feature ridges or curves that add strength. The stelo 1225 may have punched holes for eyelet attaching, pointed spurs for pressure attachment, or any other design enabling attachment to a shoe. The stelo 1225 design may be the full width of the shoe, partial width of the shoe, full length of the shoe, or partial length of the shoe in any variation and combination. In some examples, the contour of the stelo 1225 is determined by heel height.

Attachment of the heel, and avoiding inadvertent twist and potential removal, may be achieved using a number of features based on friction. Interference between the stelo 1225, heel lock 1240, and attachment platform 1210 cause friction between those parts and prevents rotation. Similarly, interference between heel platform 1260 of shoe sole element 1220 and heel attachment 1245 compresses the heel platform 1260 of shoe sole element 1220 and causes more significant friction.

A molded heel interlock pin 1265 on the stelo 1225 that extends into the heel lock 1240 may offer some additional stability, but the primary function of this feature is to join the heel attachment 1245 and stelo 1225 such that they may be removed as a single part. In some cases, the shoe does not rely on this heel interlock pin 1265 for structural stability. Rather, the stability and rigidity of the joint between the stelo 1225 and the heel attachment 1245 may be achieved by the contact between the top of the heel lock 1240 and the underside surface of the stelo 1225. These two parts may be sandwiched together by the attachment platform 1210. The overall diameter of the features in this 'sandwich' may be a significant factor in determining the stability of the high heel shoe 1200.

In some cases, plastics tend towards relieving such stresses over time. Thus, an extended nub may be provided on the stelo 1225 to momentarily interfere and 'bump over' a corresponding feature on the heel attachment 1245 (not shown).

Footbed 1205 may be an example of, or include aspects of, the corresponding element described with reference to FIG. 13.

The attachment platform 1210 may be an example of an interlocking portion of the heel platform 1260. In some examples, attachment platform 1210 includes a puck coupled to the heel platform 1260. Attachment platform 1210 may be an example of, or include aspects of, the corresponding element described with reference to FIGS. 1-7, 9, 10, 11, 13, 15, 17, and 22-24.

Heel cap 1215 may be an example of, or include aspects of, the corresponding element described with reference to FIGS. 21 and 22. The shoe sole element 1220 may be an example of a flexible sole element interposed between the toe box platform and the footbed 1205. The shoe sole element 1220 may include heel platform 1265. Shoe sole element 1220 may be an example of, or include aspects of, the corresponding element described with reference to FIGS. 1-5, 10, 11, 13, 15, and 22-24.

The stelo 1225 may include a rigid shank 1280, a toe interlock 1270, and a heel interlock pin 1265, wherein the toe interlock 1270 is configured to removably interlock with the stelo receiver of toebox platform 1235, and the heel interlock pin 1265 is configured to removably interlock with the heel lock 1240, and wherein the stelo 1225 is configured to juxtapose with the flexible shoe sole element 1220 providing a rigid support to the flexible shoe sole element 1220.

In some examples, the toe interlock 1270 includes a notch configured to interlock with the forefoot pin 1230 at the stelo receiver of the toebox platform 1235. In some examples, the stelo 1225 is interposed between the removeable heel lock 1240 and the attachment platform 1210. In some examples, the stelo 1225 includes the leading edge rib 1275 configured to engage the heel attachment 1245. In some examples, the stelo 1225 has a lateral curved profile. In some examples, the stelo 1225 includes the heel interlock pin 1265 coaxial with an axis of rotation of the removable heel lock 1245, wherein the removable heel lock 1240 includes a cylindrical cavity configured to receive the heel interlock pin 1265. In some examples, the stelo 1225 includes the heel interlock pin 1265, wherein the heel interlock pin 1265 includes a compressible distal end. In some examples, the stelo 1225 includes a recurve, e.g., an "S" shape. Stelo 1225 may be an example of, or include aspects of, the corresponding element described with reference to FIGS. 1-9, 13, 14, 16, and 22-24.

Forefoot pin 1230 may be an example of, or include aspects of, the corresponding element described with reference to FIG. 13. The toebox base 1235 may be an example of a toe box platform including a stelo receiver. In some examples, the stelo receiver includes a forefoot pin 1230 oriented laterally at a proximal portion of the toe box platform.

Toebox base 1235 may be an example of, or include aspects of, the corresponding element described with reference to FIGS. 1-6, 9, 10, 11, 13, and 14. Heel lock 1240 may be an example of, or include aspects of, the corresponding element described with reference to FIGS. 15, 18, 19, 20, and 22.

The heel attachment 1245 may be an example of a removable heel removably coupleable to the heel platform at the interlocking portion of the heel platform 1260 (i.e. the attachment platform 1210). In some examples, the stelo 1225 and the removable heel attachment 1245 are configured to remain together upon removal of the removable heel from the interlocking portion of the heel platform 1260. In some examples, the removable heel attachment 1245 is configured to release from the interlocking portion by rotating the removable heel attachment 1245 by at least fifteen degrees. Heel attachment 1245 may be an example of, or include aspects of, the corresponding element described with reference to FIGS. 1-5, 9, 14, 18, 19, and 22-24.

Heel rod 1250 may be an example of, or include aspects of, the corresponding element described with reference to FIG. 19. Heel tip 1255 may be an example of, or include aspects of, the corresponding element described with reference to FIGS. 14, 18, and 19.

Table 1, below, summarizes ranges and specifications for one example of a high heel shoe in accordance with the present disclosure.

TABLE 1

| Parameter | Description | Lower Threshold | Upper Threshold |
|---|---|---|---|
| F-twist | Highest twisting force (moment) encountered during heel release and install | 0.3 Nm | 1.3 Nm |

TABLE 1-continued

| Parameter | Description | Lower Threshold | Upper Threshold |
|---|---|---|---|
| Θ-stelo | Nominal angle of release (and install angle) of the stelo from around forefoot pin | 15 degrees | 90 degrees |
| F-hs | Force required to separate heel and stelo | 2N | 25N |
| F-ci | Force required to install the heel cap | 40N | 120N |
| F-co | Force required at leading edge to remove heel cap (note that Shank may be used to pry out Heel Cap) | 10N | 70N |
| K-sB | Bending stiffness of the stelo | 600 $kNmm^2$ | No upper limit |

Figure 13:
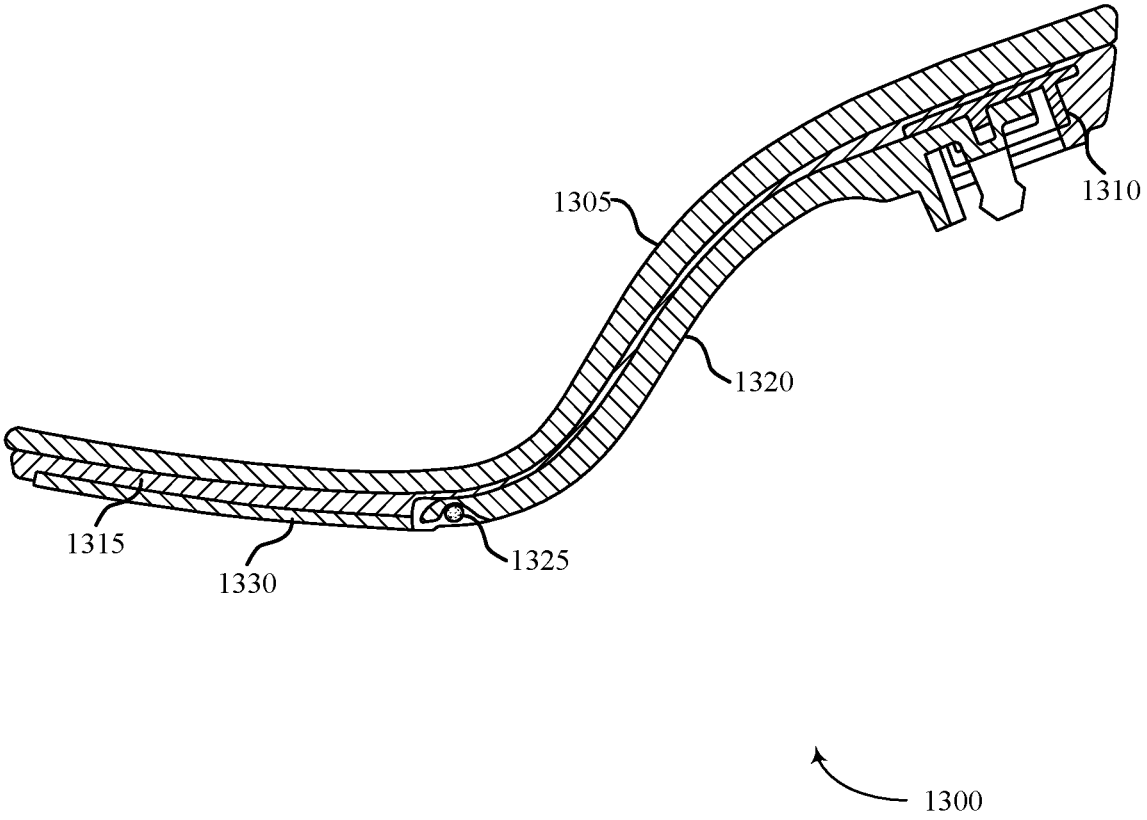

FIG. 13 shows an example of a side view of a high heel shoe base 1300 in accordance with aspects of the present disclosure. High heel shoe base 1300 may be an example of, or include aspects of, the corresponding element described with reference to FIGS. 1-9, 14, and 15. High heel shoe base 1300 may include footbed 1305, attachment platform 1310, shoe sole element 1315, stelo 1320, forefoot pin 1325, toebox base 1330, heel platform 1335, heel interlock pin 1340, toe interlock 1345, leading edge rib 1350, and shank 1355.

Footbed 1305 may be an example of, or include aspects of, the corresponding element described with reference to FIG. 12. Attachment platform 1310 may be an example of, or include aspects of, the corresponding element described with reference to FIGS. 1-7, 9-12, 15, 17, and 22-24.

Shoe sole element 1315 may be an example of, or include aspects of, the corresponding element described with reference to FIGS. 1-5, 10-12, 15, and 22-24.

Stelo 1320 may be an example of, or include aspects of, the corresponding element described with reference to FIGS. 1-9, 12, 14, 16, and 22-24. Forefoot pin 1325 may be an example of, or include aspects of, the corresponding element described with reference to FIG. 12. Toebox base 1330 may be an example of, or include aspects of, the corresponding element described with reference to FIGS. 1-6, 9-12, and 14.

Figure 14:
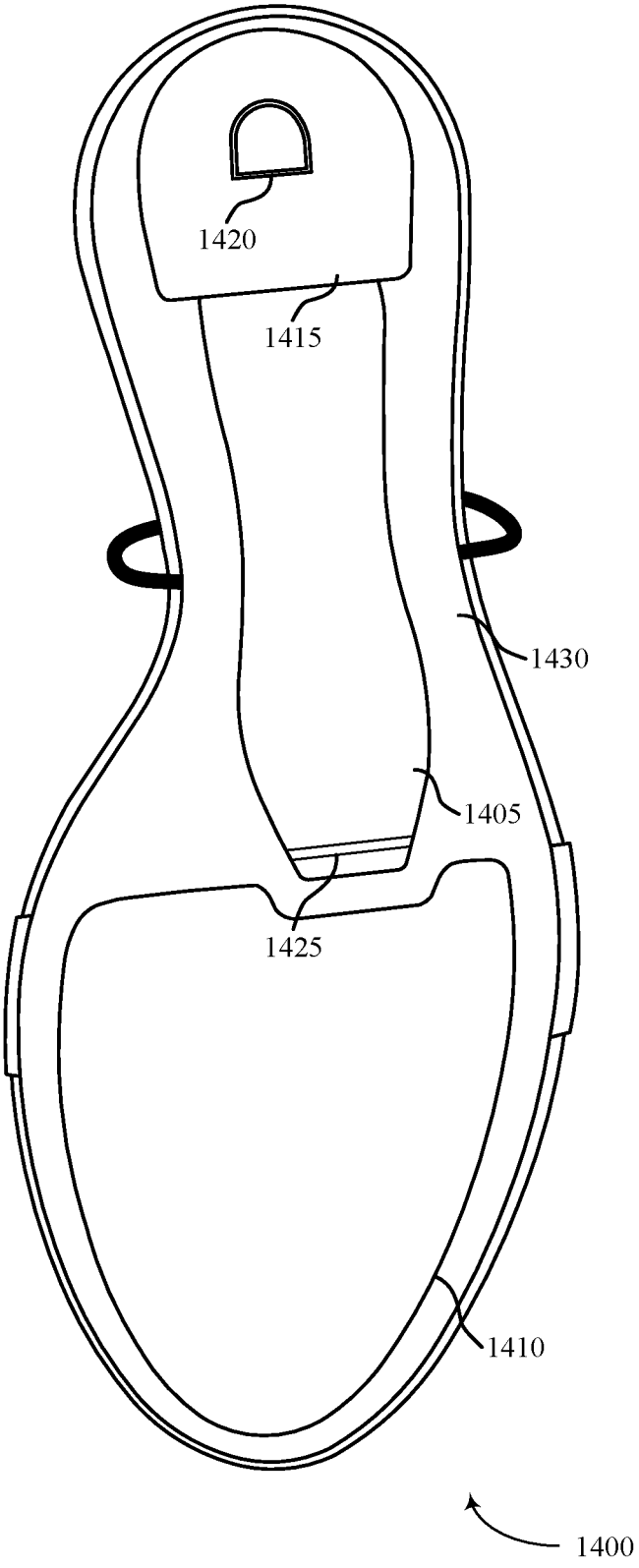

FIG. 14 shows an example of a bottom view of a high heel shoe base 1400 in accordance with aspects of the present disclosure. High heel shoe base 1400 may be an example of, or include aspects of, the corresponding element described with reference to FIGS. 1-9, 13, and 15. High heel shoe base 1400 may include stelo 1405, toebox base 1410, heel attachment 1415, heel tip 1420, forefoot pin 1425, and shoe sole element 1430.

Stelo 1405 may be an example of, or include aspects of, the corresponding element described with reference to FIGS. 1-9, 12, 13, 16, and 22-24. Toebox base 1410 may be an example of, or include aspects of, the corresponding element described with reference to FIGS. 1-6, 9-12, and 13.

Heel attachment 1415 may be an example of, or include aspects of, the corresponding element described with reference to FIGS. 1-5, 9, 12, 18, 19, and 22-24. Heel tip 1420 may be an example of, or include aspects of, the corresponding element described with reference to FIGS. 12, 18, and 19.

Figure 15:
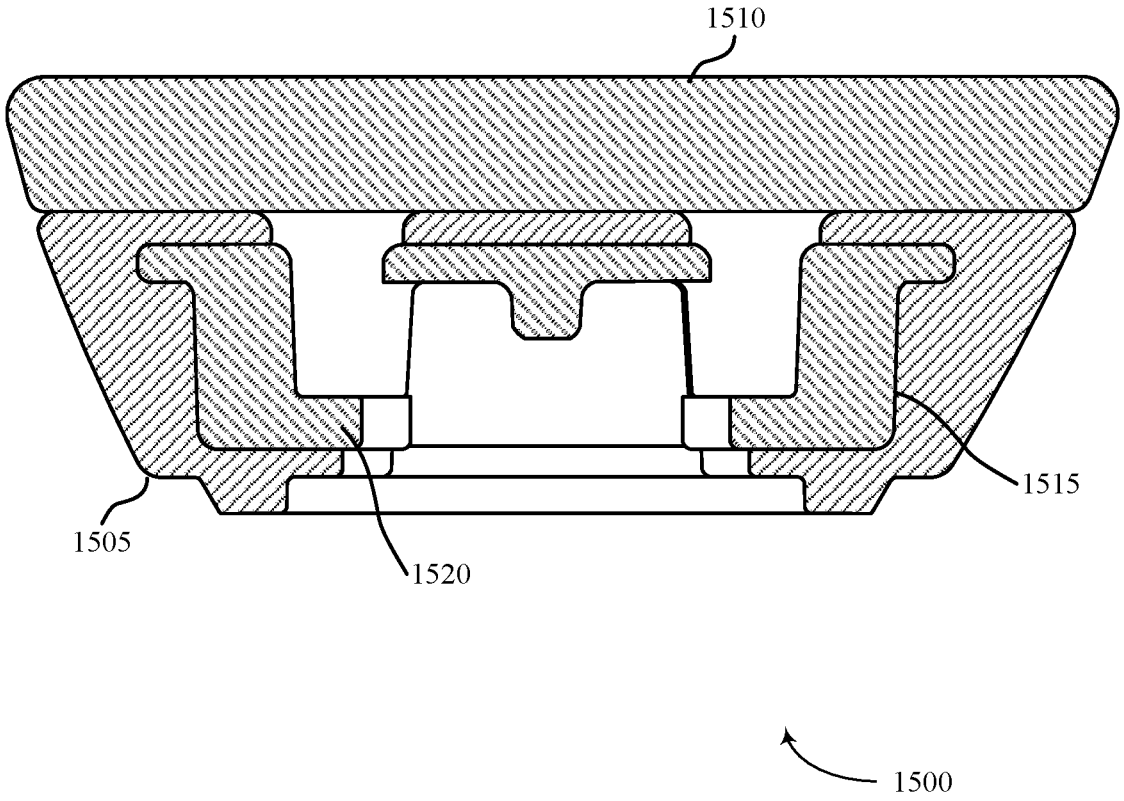

FIG. 15 shows an example of a back view cross section of the back of a high heel shoe base 1500 in accordance with aspects of the present disclosure. High heel shoe base 1500 may be an example of, or include aspects of, the corresponding element described with reference to FIGS. 1-9, 13, and 14. High heel shoe base 1500 may include heel platform 1505, footbed 1510, attachment platform 1515, and interlocking portion 1520.

Attachment platform 1515 may be an example of, or include aspects of, the corresponding element described with reference to FIGS. 1-7, 9-13, 17, and 22-24. Heel platform 1505 may be an example of, or include aspects of, the corresponding element described with reference to FIGS. 1-5, 10-13, 15, and 22-24. Footbed 1510 may be an example of, or include aspects of, the corresponding element described with reference to FIGS. 12, 13, 15, and 22.

Figure 16:
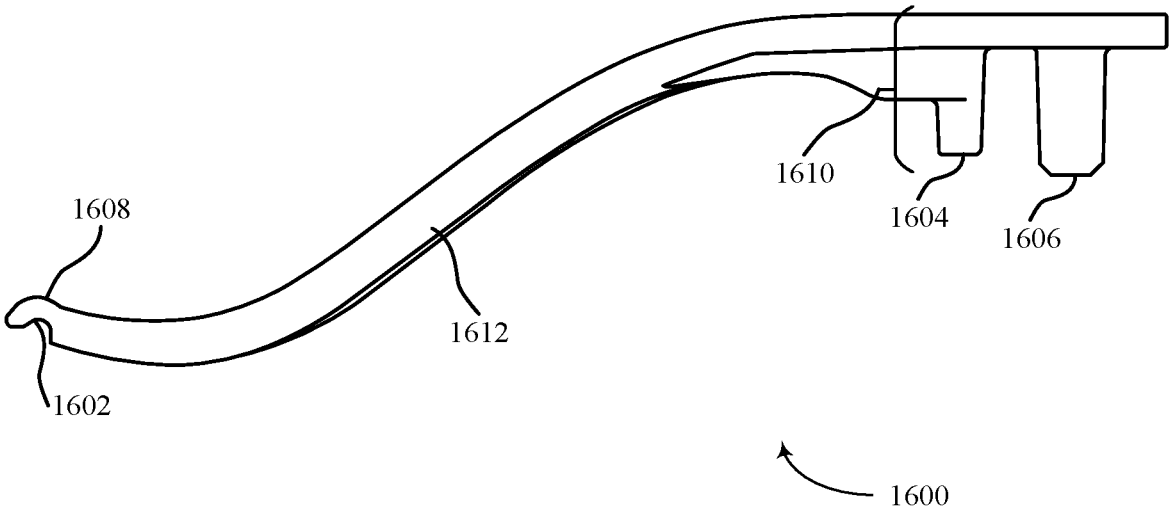

FIG. 16 shows an example of a side view of a stelo 1600 in accordance with aspects of the present disclosure. Stelo 1600 may be an example of, or include aspects of, the corresponding element described with reference to FIGS. 1-9, 12-14, and 22-24.

The stelo 1600 may include a rigid shank 1612, a toe interlock 1608, and a heel interlock 1610, wherein the toe interlock 1608 is configured to removably interlock with the stelo receiver of the toebox platform, and the heel interlock 1610 is configured to removably interlock with the heel lock and the interlocking portion of the heel platform, and wherein the stelo 1600 is configured to juxtapose with the flexible shoe sole element providing a rigid support to the flexible shoe sole element.

In some examples, the toe interlock 1608 includes a notch 1602 configured to interlock with the forefoot pin at the stelo receiver of the toebox platform. In some examples, the stelo 1600 is interposed between the removeable heel and the interlocking portion of the heel platform of the shoe sole element at the opposite end of the stelo 1600 from the notch 1602. In some examples, the stelo 1600 includes a leading edge rib 1604 configured to engage the heel attachment. In some examples, the stelo 1600 has a lateral curved profile. In some examples, the stelo 1600 includes a post 1606 (or heel interlock pin) coaxial with an axis of rotation of the removable heel lock, wherein the removable heel lock includes a cylindrical cavity configured to receive the post (heel interlock pin) 1606. In some examples, the stelo 1600 includes the post (heel interlock pin) 1606, wherein the post (heel interlock pin) 1606 includes a compressible distal end. In some examples, the stelo 1600 includes a recurve.

Figure 17:
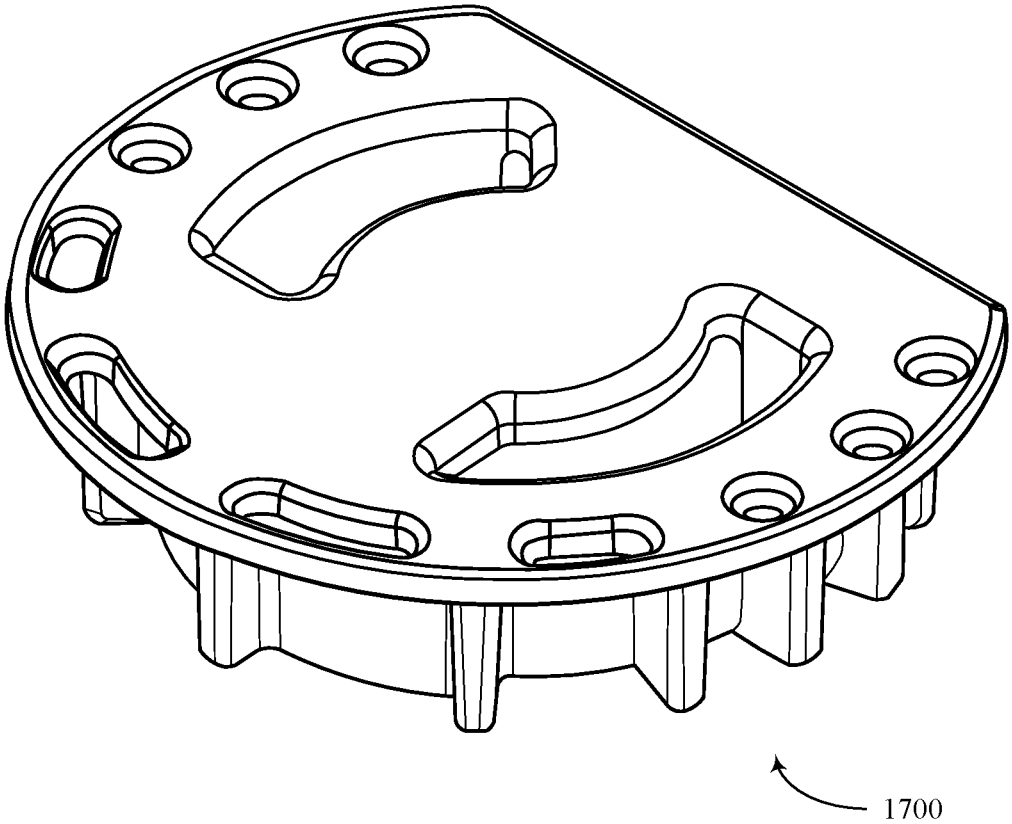
Figure 17:
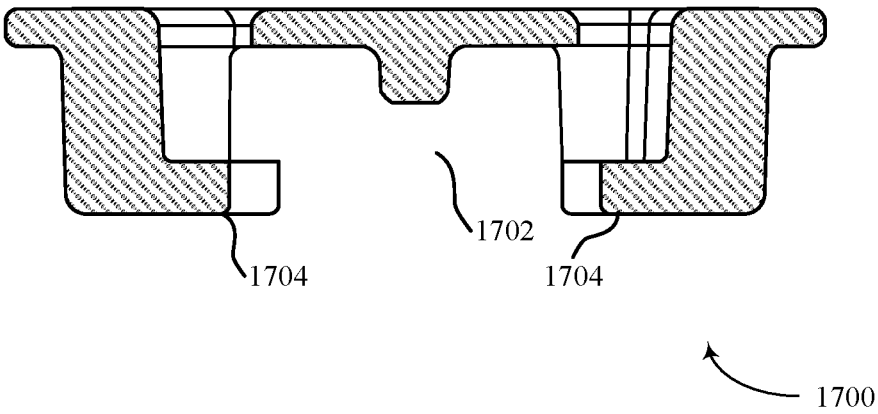

FIG. 17 shows an example of an attachment platform 1700 in accordance with aspects of the present disclosure. The attachment platform 1700 may be an example of an interlocking portion of a heel platform.

In some examples, the interlocking portion includes the attachment platform 1700 (a puck) coupled to the heel platform of the shoe sole element. Attachment platform 1700 may be an example of, or include aspects of, the corresponding element described with reference to FIGS. 1-7, 9-13, 15, and 22-24.

Figure 20:
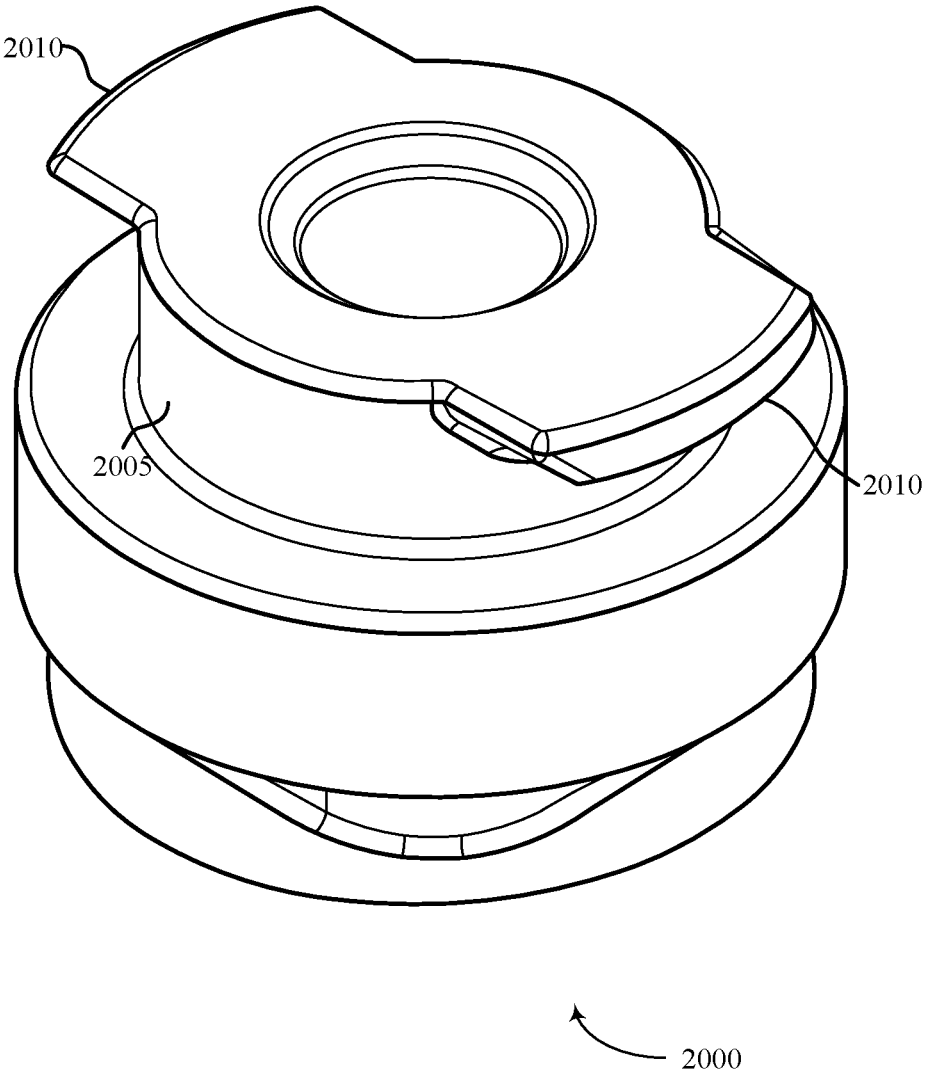

The attachment platform 1700, in accordance with the present example, includes the female half of a quarter turn cam lock fastener. A cylindrical opening 1702 in the attachment platform includes a pair of notches 1704 (of greater diameter than the cylindrical opening) that allow a pair of "ears" on a post of a male half of the quarter turn cam lock fastener (included in the heel lock, as shown in FIG. 20).

In operation, once the post of the heel lock is inserted into the cylindrical opening 1702, with the ears of the heel lock post aligned with the notches 1704, the heel is rotated a quarter turn, misaligning the ears, so that the post of the heel lock can no longer be removed from the cylindrical opening 1702. At the same time, camming surfaces on the bottom surface of the ears cause the heel to be drawn tightly toward the attachment platform 1700, so as to increase stability of the heel relative to the attachment platform 1700, and to increase the force required to overcome friction to rotate the heel into a position where it can be removed (i.e., where the ears are aligned with the notches and the post can be removed from the cylindrical opening). As the heel is drawn tightly toward the attachment platform 1700, the stelo is also secured between the heel and the attachment platform 1700. The configuration of the heel area of the shoe after the post of the heel lock is inserted in the cylindrical opening 1702 and turned is shown in FIG. 22.

Figure 18:
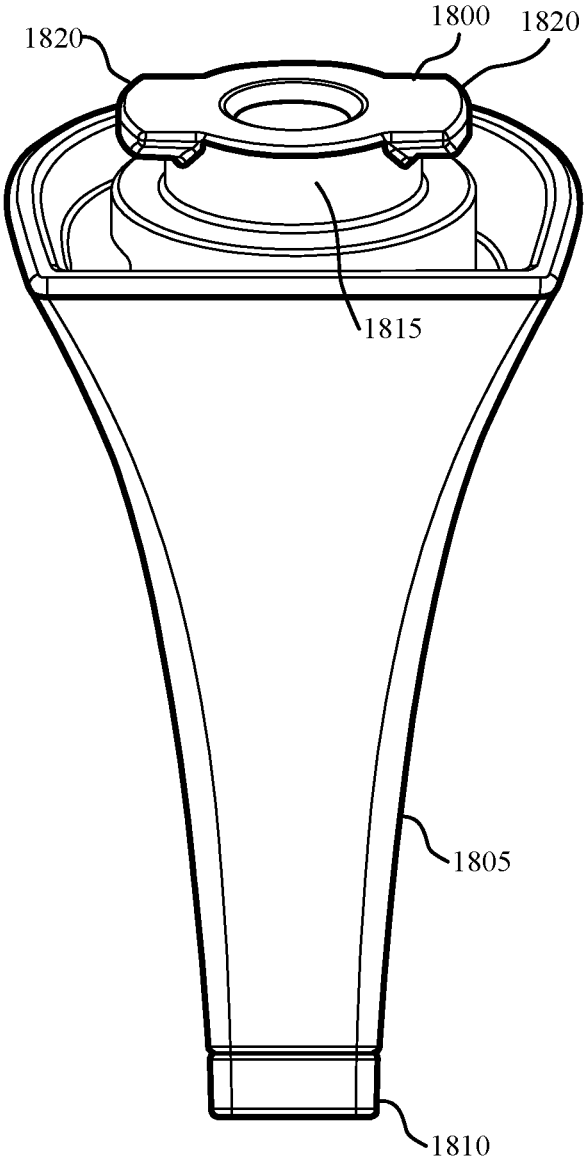

FIG. 18 shows an example of a front view of a removable heel assembly 1815 in accordance with aspects of the present disclosure. The example shown includes heel lock 1800, heel attachment 1805, heel tip 1810, heel lock post 1815, and cam lock ears 1820.

Heel lock 1800 may be an example of, or include aspects of, the corresponding element described with reference to FIGS. 12, 15, 19, 20, and 22. Heel attachment 1805 may be an example of, or include aspects of, the corresponding element described with reference to FIGS. 1-5, 9, 12, 14, 19, and 22-24. Heel tip 1810 may be an example of, or include aspects of, the corresponding element described with reference to FIGS. 12, 14, and 19.

Figure 19:
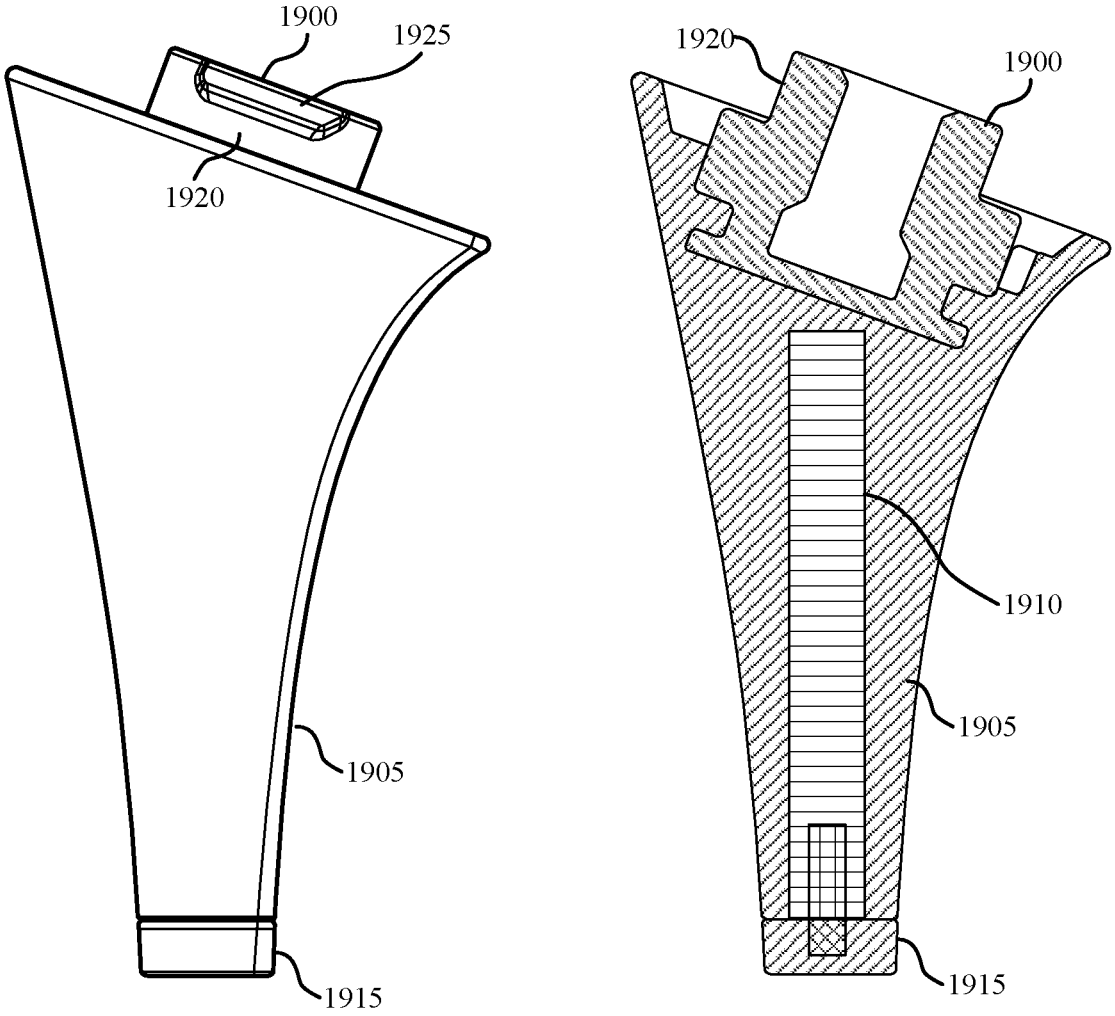

FIG. 19 shows an example of a side view of a removable heel assembly 1920 in accordance with aspects of the present disclosure. The example shown includes heel lock 1900, heel attachment 1905, heel rod 1910, heel tip 1915, heel lock post 1920, and cam lock ears 1925.

Heel lock 1900 may be an example of, or include aspects of, the corresponding element described with reference to FIGS. 12, 15, 18, 20, and 22. Heel attachment 1905 may be an example of, or include aspects of, the corresponding element described with reference to FIGS. 1-5, 9, 12, 14, 18, and 22-24.

Heel rod 1910 may be an example of, or include aspects of, the corresponding element described with reference to FIG. 12. Heel tip 1915 may be an example of, or include aspects of, the corresponding element described with reference to FIGS. 12, 14, and 18.

FIG. 20 shows an example of a heel lock 2000 in accordance with aspects of the present disclosure. The heel lock 2000 includes heel lock post 2005 and cam lock ears 2010. Heel lock 2000 may be an example of, or include aspects of, the corresponding element described with reference to FIGS. 12, 15, 17, 18, 19, and 22.

Figure 21:
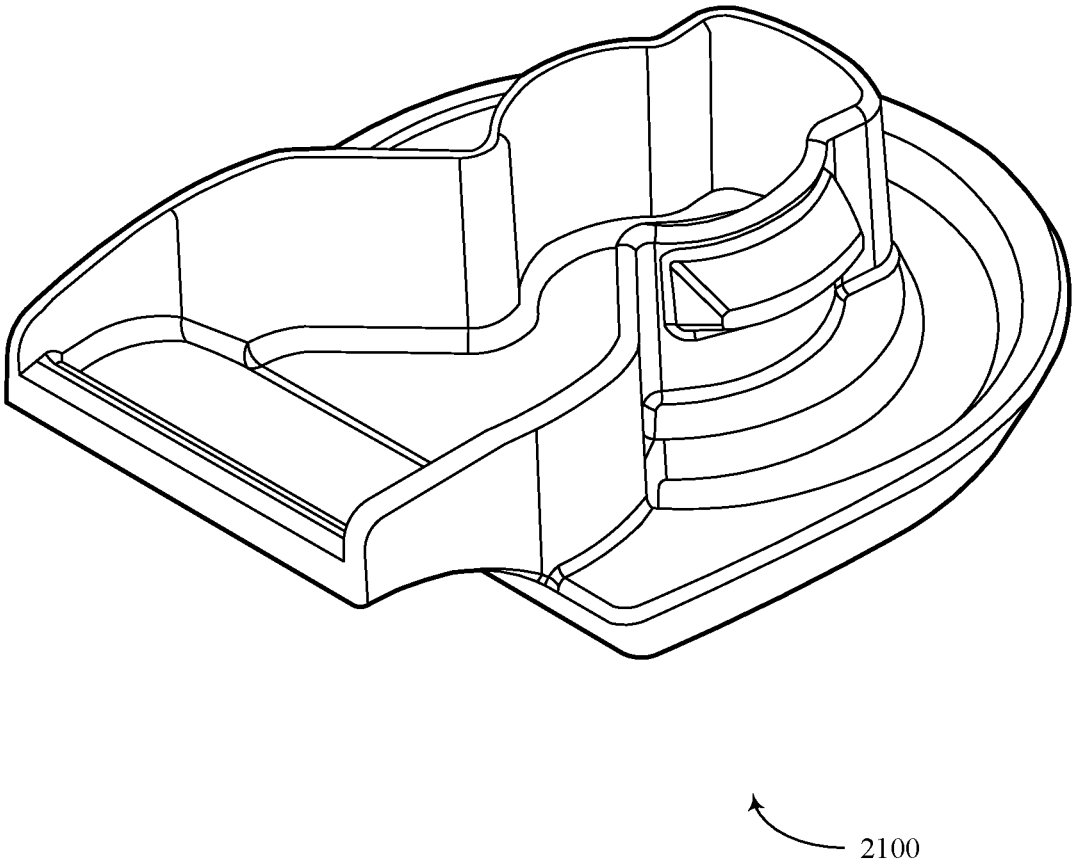

FIG. 21 shows an example of a heel cap 2100 in accordance with aspects of the present disclosure. Heel cap 2100 may be an example of, or include aspects of, the corresponding element described with reference to FIGS. 12 and 22. The heel cap 2100 may install in the heel platform when the heel lock is removed. In accordance with the present document, the heel cap 2100 is held in place by friction, and prevents debris, such as dirt and rocks, from damaging or clogging the heel platform when the shoe is used with the heel and stelo removed.

Figure 22:
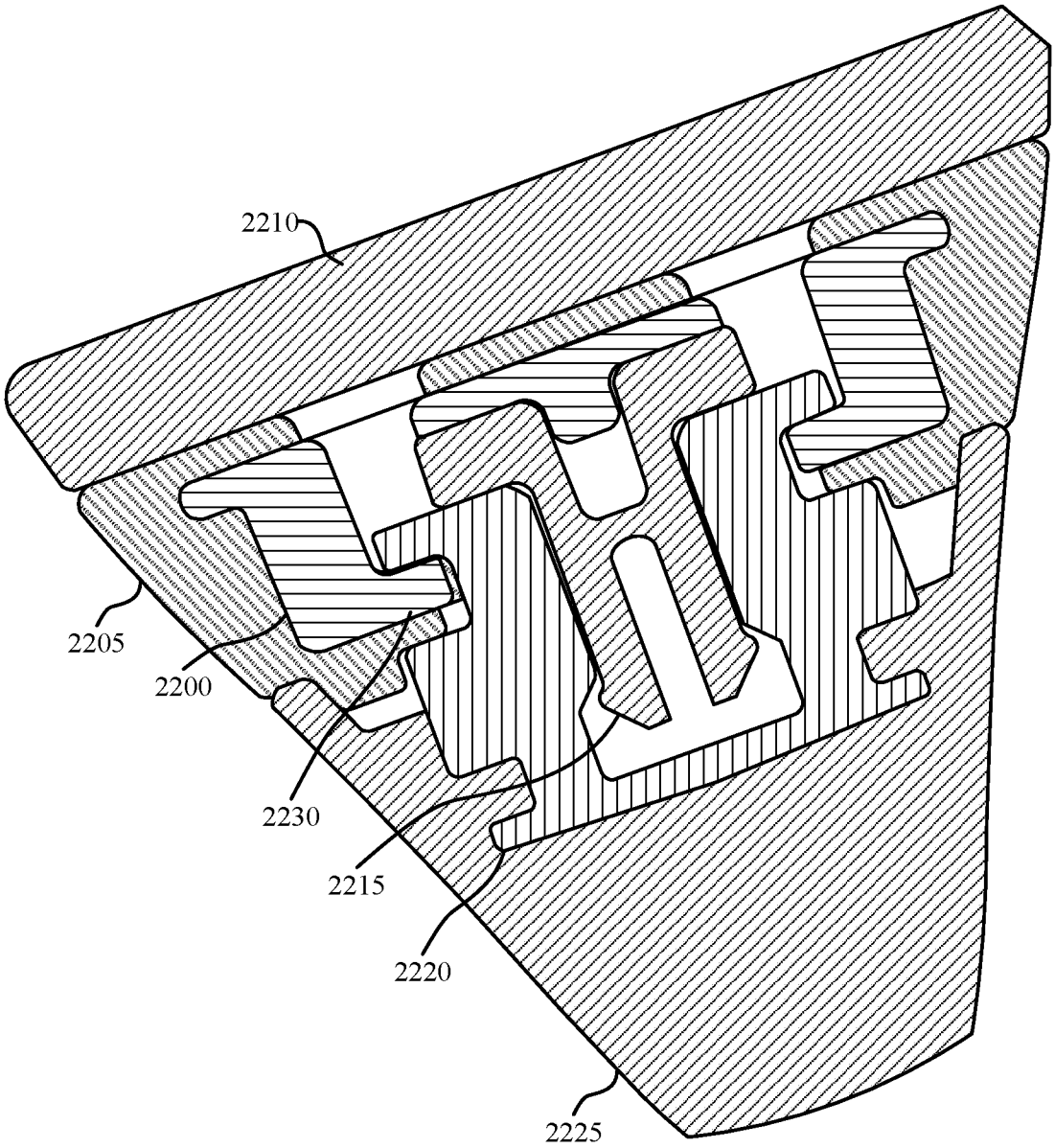

FIG. 22 shows an example of a side view cross section of the back of a high heel shoe base in accordance with aspects of the present disclosure. The example shown includes attachment platform 2200, heel platform 2205, footbed 2210, stelo 2215, heel lock 2220, heel attachment 2225, and interlocking portion 2230.

Attachment platform 2200 may be an example of, or include aspects of, the corresponding element described with reference to FIGS. 1-7, 9-13, 15, 17, 22, 23, and 24. Heel platform 2205 may be an example of, or include aspects of, the corresponding element described with reference to FIGS. 12 and 21.

Footbed 2210 may be an example of, or include aspects of, the corresponding element described with reference to FIGS. 12, 13, 15, and 22. Stelo 2215 may be an example of, or include aspects of, the corresponding element described with reference to FIGS. 1-9, 12-14, 16, 23, and 24.

Heel lock 2220 may be an example of, or include aspects of, the corresponding element described with reference to FIGS. 12, 15, 18, 19, and 20. Heel attachment 2225 may be an example of, or include aspects of, the corresponding element described with reference to FIGS. 1-5, 9, 12, 14, 18, 19, 23, and 24.

The stelo 2215 is shown interlocking with the heel lock 2220, and the heel lock 2220 is shown interlocking with the interlocking portion 2230 of the heel platform 2205.

Figure 23:
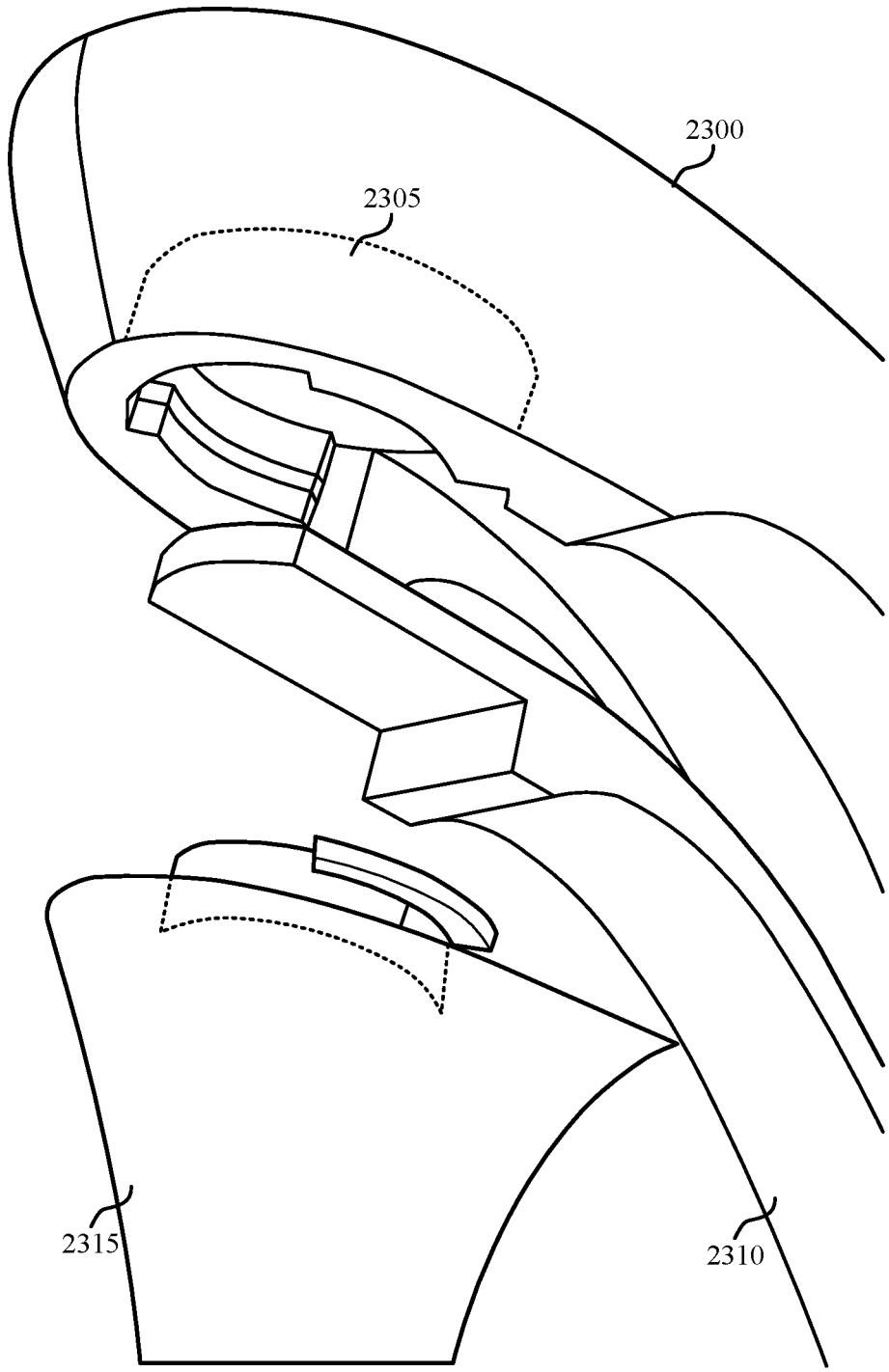

FIG. 23 shows an example of a high heel shoe heel connection mechanism in accordance with aspects of the present disclosure. The example shown includes shoe sole element 2300, attachment platform 2305, stelo 2310, and heel attachment 2315.

This example illustrates an example heel connection mechanism that may provide a larger heel/mid-sole connection area. This embodiment does not rely on the shoe sole element 2300 for the connection, and may thus be easy to clean, strong and durable. In another similar embodiment (not shown), a heel lock has narrow tabs, more like a T-shape and less like wings. The heel lock extends up from the heel and passes through the stelo 2310. This embodiment may rely on the compression of the shoe sole element to maintain stability and strength.

Shoe sole element 2300 may be an example of, or include aspects of, the corresponding element described with reference to FIGS. 1-5, 10-13, 15, 22, and 24. Attachment platform 2305 may be an example of, or include aspects of, the corresponding element described with reference to FIGS. 1-7, 9-13, 15, 17, 22, and 24.

Stelo 2310 may be an example of, or include aspects of, the corresponding element described with reference to FIGS. 1-9, 12-14, 16, 22, and 24. Heel attachment 2315 may be an example of, or include aspects of, the corresponding element described with reference to FIGS. 1-5, 9, 12, 14, 18, 19, 22, and 24.

Figure 24:
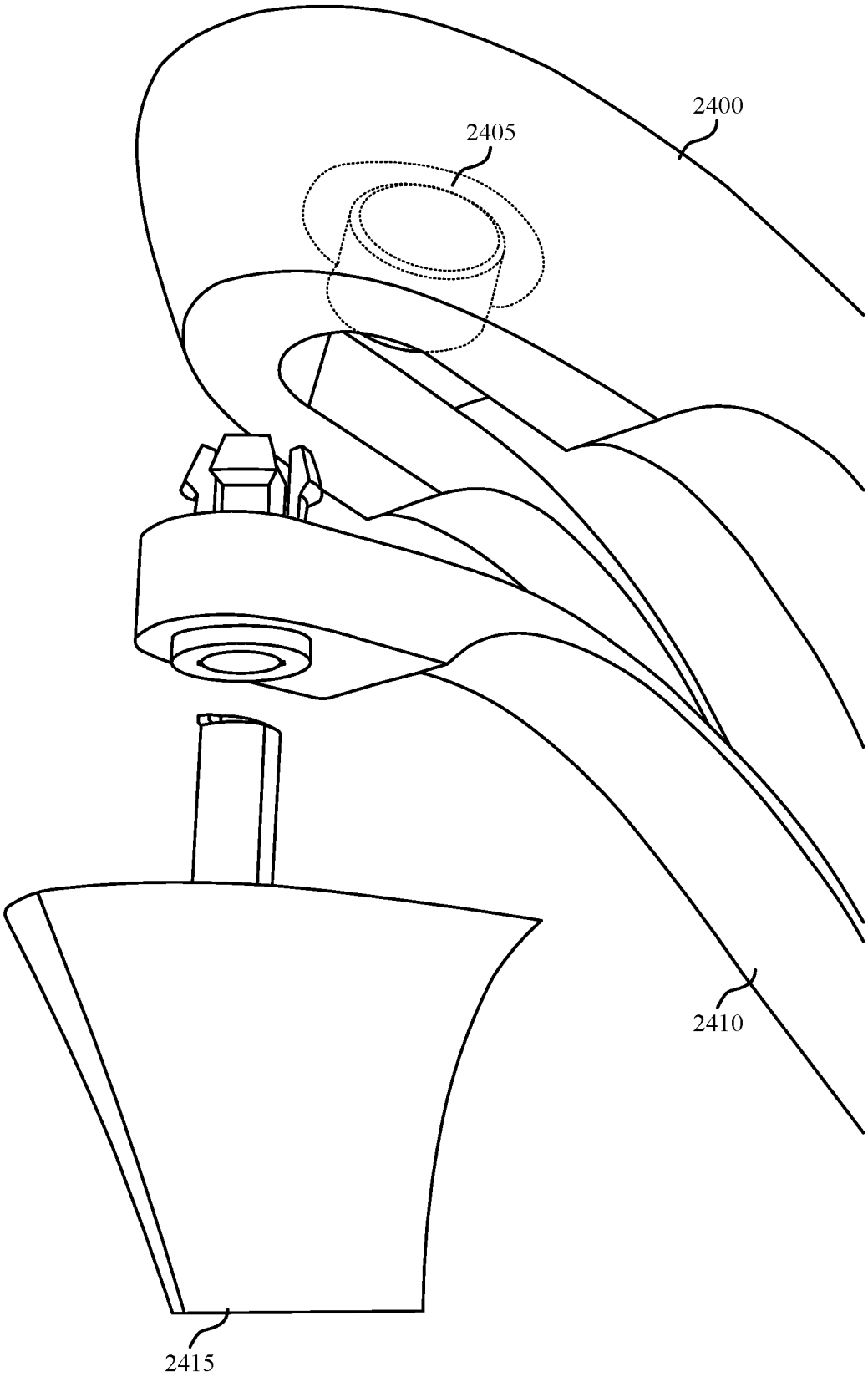

FIG. 24 shows an example of a high heel shoe heel connection mechanism in accordance with aspects of the present disclosure. The example shown includes shoe sole element 2400, attachment platform 2405, stelo 2410, and heel attachment 2415.

This example illustrates an example of a simplified heel connection mechanism where the heel attachment 2415 and stelo 2410 may be removed or installed as a single unit. This embodiment enables heel wear to be hidden within the design, and may eliminate the need for a heel cap. The fasteners on the stelo 2410 may use a cam-lock style action to hold together. They are installed with a push and removed with a pull. In some examples, the fasteners on the stelo 2410 are unable to release until an inner cylinder on the heel attachment 2415 is pulled out.

Shoe sole element 2400 may be an example of, or include aspects of, the corresponding element described with reference to FIGS. 1-5, 10-13, 15, 22, and 23. Attachment platform 2405 may be an example of, or include aspects of, the corresponding element described with reference to FIGS. 1-7, 9-13, 15, 17, 22, and 23.

Stelo 2410 may be an example of, or include aspects of, the corresponding element described with reference to FIGS. 1-9, 12-14, 16, 22, and 23. Heel attachment 2415 may be an example of, or include aspects of, the corresponding element described with reference to FIGS. 1-5, 9, 12, 14, 18, 19, 22, and 23.

The post of the stelo 2410, described above, includes a cylindrical core with a compressible, expandable distal end. When the stelo is inserted in the the attachment mechanism, the compressible, expandable distal end frictionally engages with the attachment mechanism 2405. Additional travel allows the distal end to expand back to its relaxed state. When a cylindrical portion of the heel lock of the embodiment of FIG. 24 is inserted into the stelo, through the cylindrical core, the compressible, expandable distal end is prevented from compressing, thereby mechanically locking the heel lock and stelo assembly into a region of greater diameter within the attachment mechanism, thereby locking the stelo to the attachment mechanism.

Figure 25:
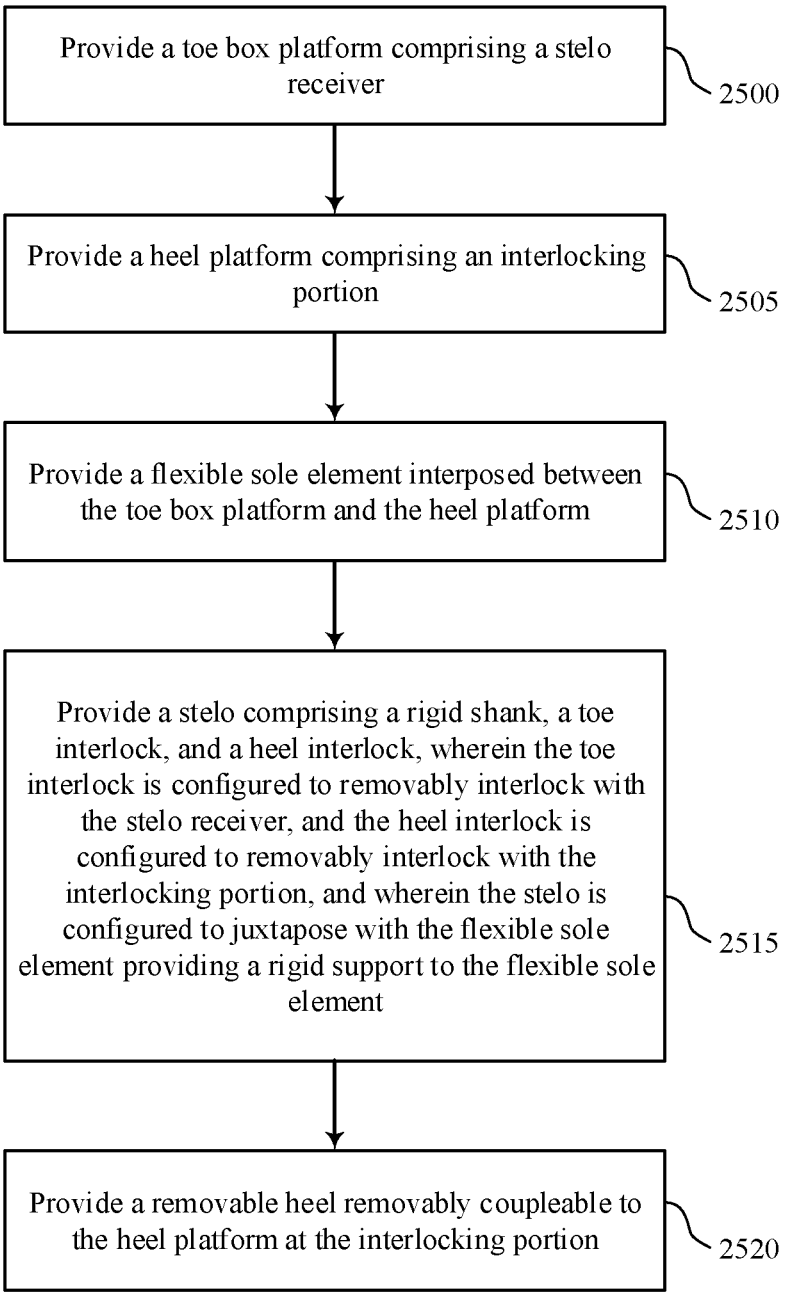

FIG. 25 shows an example of a process for producing a shoe in accordance with aspects of the present disclosure. In some examples, these operations may be performed manually, by machine, or by an automated process controlled by a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various substeps, or may be performed in conjunction with other operations described herein.

At step 2500, a system may provide a toe box platform including a stelo receiver. In some cases, the operations of this step may refer to a toebox base as described with reference to FIGS. 1-6, 9-13, and 14.

At step 2505, a system may provide a heel platform including an interlocking portion. In some cases, the operations of this step may refer to an attachment platform as described with reference to FIGS. 1-7, 9-13, 15, 17, and 22-24.

At step 2510, a system may provide a flexible sole element interposed between the toe box platform and the heel platform. In some cases, the operations of this step may refer to a shoe sole element as described with reference to FIGS. 1-5, 10-13, 15, and 22-24.

At step 2515, a system may provide a stelo including a rigid shank, a toe interlock, and a heel interlock, wherein the toe interlock is configured to removably interlock with the stelo receiver, and the heel interlock is configured to removably interlock with the interlocking portion, and wherein the stelo is configured to juxtapose with the flexible sole element providing a rigid support to the flexible sole element. In some cases, the operations of this step may refer to a stelo as described with reference to FIGS. 1-9, 12-14, 16, and 22-24.

At step 2520, a system may provide a removable heel removably coupleable to the heel platform at the interlocking portion. In some cases, the operations of this step may refer to a heel attachment as described with reference to FIGS. 1-5, 9, 12, 14, 18, 19, and 22-24.

Figure 26:
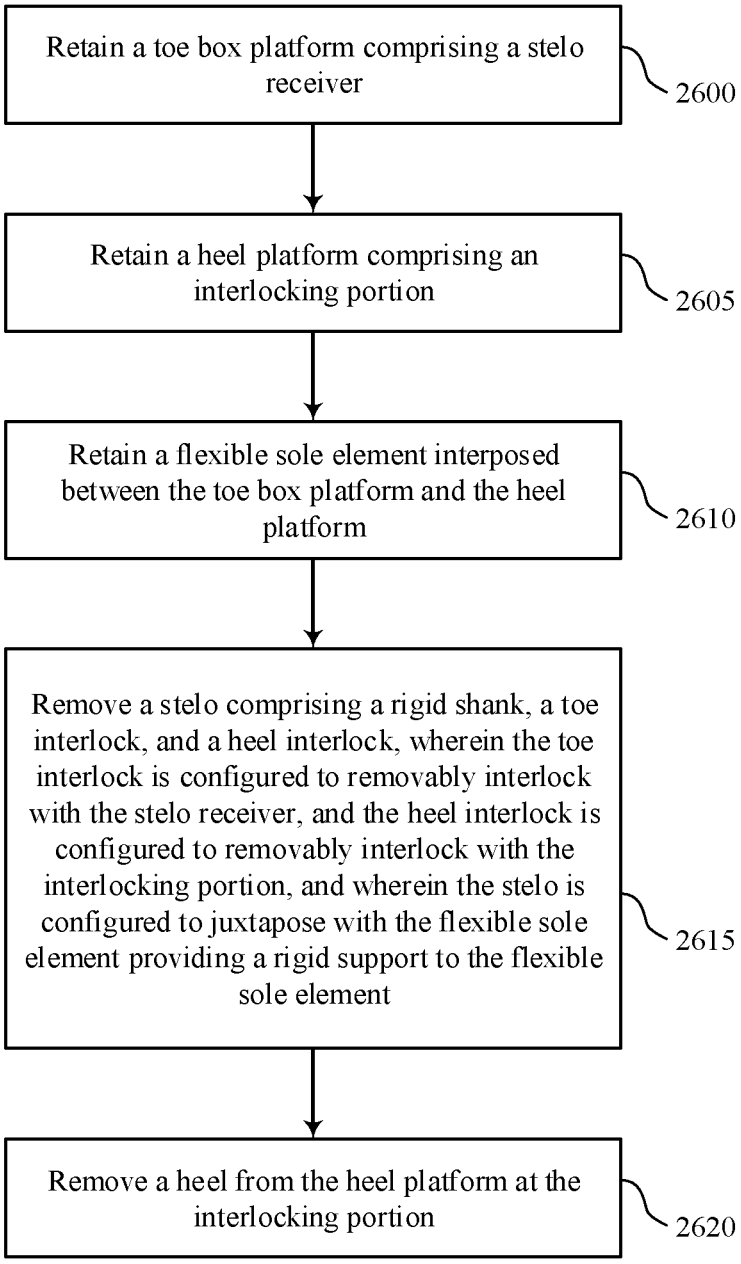

FIG. 26 shows an example of a process for transforming a high heel shoe to a low heel shoe in accordance with aspects of the present disclosure. Generally, these operations may be performed according to the methods and processes described in accordance with aspects of the present disclosure. For example, the operations may be composed of various substeps, or may be performed in conjunction with other operations described herein.

At step 2600, a system may retain a toe box platform including a stelo receiver. In some cases, the operations of this step may refer to a toebox base as described with reference to FIGS. 1-6, 9-13, and 14.

At step 2605, a system may retain a heel platform including an interlocking portion. In some cases, the operations of this step may refer to an attachment platform as described with reference to FIGS. 1-7, 9-13, 15, 17, and 22-24.

At step 2610, a system may retain a flexible sole element interposed between the toe box platform and the heel platform. In some cases, the operations of this step may refer to a shoe sole element as described with reference to FIGS. 1-5, 10-13, 15, and 22-24.

At step 2615, a system may remove a stelo including a rigid shank, a toe interlock, and a heel interlock, wherein the toe interlock is configured to removably interlock with the stelo receiver, and the heel interlock is configured to removably interlock with the interlocking portion, and wherein the stelo is configured to juxtapose with the flexible sole element providing a rigid support to the flexible sole element. In some cases, the operations of this step may refer to a stelo as described with reference to FIGS. 1-9, 12-14, 16, and 22-24.

At step 2620, a system may remove a heel from the heel platform at the interlocking portion. In some cases, the operations of this step may refer to a heel attachment as described with reference to FIGS. 1-5, 9, 12, 14, 18, 19, and 22-24.

While the invention herein disclosed has been described by means of specific embodiments, examples and applications thereof, numerous modifications and variations could be made thereto by those skilled in the art without departing from the scope of the invention set forth in the claims.

What is claimed is:

1. A shoe comprising:

a toe box platform comprising a stelo receiver;

a heel platform comprising an interlocking portion comprising a female half of a cam lock fastener;

a flexible sole element connecting the toe box platform and the heel platform;

a removable stelo comprising a rigid shank, a toe interlock, and a heel interlock, wherein the toe interlock is configured to removably interlock with the stelo receiver, and wherein the removable stelo is configured to juxtapose with an underside of the flexible sole element to provide a rigid support to the flexible sole element; and a removable heel including a heel lock comprising a male half of the cam lock fastener, wherein the heel lock is configured to removably interlock to the heel interlock and independently removably interlock to the interlocking portion via the cam lock fastener, whereby the interlocking of the removable heel to the interlocking portion also attaches the heel interlock to the heel platform, and wherein the removable heel, removable stelo, and interlocking portion are configured such that unlocking the male half from the female half releases the removable heel from the interlocking portion, whereby upon release the removable heel is removable from the shoe, whereby in response to removal of the removable heel from the shoe the removable stelo is also removed from the shoe as a result of the interlock of the heel lock with the heel interlock.

2. The shoe of claim 1, wherein:

said interlocking portion comprises an attachment platform coupled to the heel platform.

3. The shoe of claim 1, wherein:

said stelo receiver comprises a forefoot pin oriented laterally at a proximal portion of the toe box platform.

4. The shoe of claim 3, wherein:

said toe interlock comprises a notch configured to interlock with said forefoot pin at said stelo receiver.

5. The shoe of claim 1, wherein:

said removable stelo and said removable heel are configured to remain together upon removal of the removable heel from the interlocking portion.

6. The shoe of claim 1, wherein:

said removable heel is configured to release from said interlocking portion by rotating said removable heel by at least fifteen degrees.

7. The shoe of claim 1, wherein:

said removable stelo comprises a leading edge rib configured to engage the interlocking portion.

8. The shoe of claim 1, wherein:

said removable stelo has a lateral curved profile.

9. The shoe of claim 1, wherein:

said removable stelo comprises a post coaxial with an axis of rotation of the removable heel, wherein the removable heel comprises a cylindrical cavity configured to receive the post.

10. The shoe of claim 9, wherein:

said removable stelo comprises said post, wherein said post comprises a compressible distal end.

11. The shoe of claim 1, wherein:

said removable stelo comprises a recurve.

12. A method of producing a shoe, the method comprising:

providing a toe box platform comprising a stelo receiver;

providing a heel platform comprising an interlocking portion comprising a female half of a cam lock fastener;

providing a flexible sole element connecting the toe box platform and the heel platform;

providing a removable stelo comprising a rigid shank, a toe interlock, and a heel interlock, wherein the toe interlock is configured to removably interlock with the stelo receiver, and wherein the removable stelo is configured to juxtapose with an underside of the flexible sole element providing a rigid support to the flexible sole element; and providing a removable heel including a heel lock comprising a male half of the cam lock fastener, wherein the heel lock is configured to removably interlock to the heel interlock and independently removably interlock to the interlocking portion via the cam lock fastener, whereby the interlocking of the removable heel to the interlocking portion also attaches the heel interlock to the heel platform, and wherein the removable heel, removable stelo, and interlocking portion are produced such that unlocking the male half from the female half releases the removable heel from the interlocking portion, whereby upon release the removable heel is removable from the shoe, whereby in response to removal of the removable heel from the shoe the removable stelo is also removed from the shoe as a result of the interlock of the heel lock with the heel interlock.

13. The method of claim 12, wherein:

said interlocking portion comprises an attachment platform coupled to the heel platform.

14. The method of claim 12, wherein:

said stelo receiver comprises a forefoot pin oriented laterally at a proximal portion of the toe box platform.

15. The method of claim 14, wherein:

said toe interlock comprises a notch configured to interlock with said forefoot pin at said stelo receiver.

16. The method of claim 12, wherein:

said removable stelo and said removable heel are configured to remain together upon removal of the removable heel from the interlocking portion.

17. The method of claim 12, wherein:

said removable heel is configured to release from said interlocking portion by rotating said removable heel by at least fifteen degrees.

18. The method of claim 12, wherein:

said removable stelo comprises a leading edge rib configured to engage the interlocking portion.

19. The method of claim 12, wherein:

said removable stelo has a lateral curved profile.

20. The method of claim 12, wherein:

said removable stelo comprises a post coaxial with an axis of rotation of the removable heel, wherein the removable heel comprises a cylindrical cavity configured to receive the post.

21. The method of claim 20, wherein:

said removable stelo comprises said post, wherein said post comprises a compressible distal end.

22. The method of claim 12, wherein:

said removable stelo comprises a recurve.

23. A method of transforming a high heel shoe to a flat shoe, the method comprising:

retaining a toe box platform comprising a stelo receiver;

retaining a heel platform comprising an interlocking portion comprising a female half of a cam lock fastener;

retaining a flexible sole element connecting the toe box platform and the heel platform;

retaining a removable stelo comprising a rigid shank, a toe interlock, and a heel interlock, wherein the toe interlock removably interlocked with the stelo receiver, wherein the removable stelo is juxtaposed with an underside of the flexible sole element to provide a rigid support to the flexible sole element;

retaining a removable heel including a heel lock comprising a male half of the cam lock fastener, wherein the heel lock is removably interlocked to the heel interlock and independently removably interlocked to the interlocking portion via the cam lock fastener such that interlocking of the removable heel to the interlocking portion also attaches the heel interlock to the heel platform;

unlocking the male half from the female half, whereby the removable heel is released from the interlocking portion, whereby the removable heel is removable from the shoe;

removing the removable heel from the high heel shoe; and in response to removing the removable heel from the shoe, removing the removable stelo from the high heel shoe as a result of the interlock of the heel lock with the heel interlock.

24. The method of claim 23, wherein:

said interlocking portion comprises an attachment platform coupled to the heel platform.

25. The method of claim 23, wherein:

said stelo receiver comprises a forefoot pin oriented laterally at a proximal portion of the toe box platform.

26. The method of claim 25, wherein:

said toe interlock comprises a notch configured to interlock with said forefoot pin at said stelo receiver.

27. The method of claim 23, wherein:

said removable stelo and said removable heel are configured to remain together upon removal of the removable heel from the interlocking portion.

28. The method of claim 23, wherein:

said removable heel is configured to release from said interlocking portion by rotating said removable heel by at least fifteen degrees.

29. The method of claim 23, wherein:

said removable stelo comprises a leading edge rib configured to engage the interlocking portion.

30. The method of claim 23, wherein:

said removable stelo has a lateral curved profile.

31. The method of claim 23, wherein:

said removable stelo comprises a post coaxial with an axis of rotation of the removable heel, wherein the removable heel comprises a cylindrical cavity configured to receive the post.

32. The method of claim 31, wherein:

said removable stelo comprises said post, wherein said post comprises a compressible distal end.

33. The method of claim 23, wherein:

said removable stelo comprises a recurve.

* * * * *